US007736709B2

(12) United States Patent
Tojo et al.

(10) Patent No.: US 7,736,709 B2
(45) Date of Patent: Jun. 15, 2010

(54) RECORDING MEDIUM AND METHOD FOR MANUFACTURING RECORDING MEDIUM

(75) Inventors: Kaoru Tojo, Shizuoka-ken (JP); Yoshimitsu Arai, Shizuoka-ken (JP); Tetsunori Matsushita, Shizuoka-ken (JP); Kentaro Shiratsuchi, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 772 days.

(21) Appl. No.: 11/523,528

(22) Filed: Sep. 20, 2006

(65) Prior Publication Data

US 2007/0065606 A1 Mar. 22, 2007

(30) Foreign Application Priority Data

Sep. 22, 2005 (JP) ..... 2005-276739

(51) Int. Cl.
*B41M 5/50* (2006.01)

(52) U.S. Cl. ..... 428/32.26; 427/152; 428/32.3

(58) Field of Classification Search ..... None
See application file for complete search history.

(56) References Cited

U.S. PATENT DOCUMENTS 4,247,597 A * 1/1981 Russell, Jr. ..... 428/403
5,897,961 A * 4/1999 Malhotra et al. ..... 428/32.22

FOREIGN PATENT DOCUMENTS

| | | | |
|---|---|---|---|
| JP | 6-316145 | A | 11/1994 |
| JP | 10-193779 | A | 7/1998 |
| JP | 10-264506 | A | 10/1998 |
| JP | 2001-191639 | A | 7/2001 |

* cited by examiner

*Primary Examiner*—Bruce H. Hess
(74) *Attorney, Agent, or Firm*—Sughrue Mion, PLLC

(57) ABSTRACT

The invention discloses a recording medium containing a compound shown by the following Formula (1)

$$(Y^1)_n—Z^1—(X)_l—Z^2—(Y^2)_m \qquad \text{Formula (1)}$$

wherein, in Formula (1): each of $Z^1$ and $Z^2$ indicates a substituted or unsubstituted aromatic ring which may have a hetero atom; X indicates —O—, —S—, —S—S—, or —$C(R)_2$—; R indicates an alkyl group or a hydrogen atom; each of $Y^1$ and $Y^2$ indicates a sulfo group, a carboxyl group, a phosphono group, a carbonamide group, a sulfonamide group, or a quaternary ammonium salt; l indicates 0 or 1; and each of m and n indicates 0 or an integer of 1 or more, and at least one of m and n is an integer of 1 or more.

13 Claims, No Drawings

RECORDING MEDIUM AND METHOD FOR MANUFACTURING RECORDING MEDIUM

CROSS-REFERENCE TO RELATED APPLICATION

This application claims priority under 35 U.S.C. 119 from Japanese Patent Application No. 2005-276739, the disclosure of which is incorporated by reference herein.

BACKGROUND OF THE INVENTION

1. Field of the Invention

The invention relates to a recording medium for use in ink jet recording, digital electrophotographic recording, sublimation transfer recording, heat-sensitive recording, and thermal transfer recording methods, and to a method for manufacturing such a recording medium.

2. Description of the Related Art

Various information processing systems have recently been developed along with rapid progress in information technology industries, and recording methods and recording apparatuses suitable for these information processing systems have been developed and put into practice.

Among these recording methods, ink jet recording methods have been widely used in homes as well as in offices, since these methods are advantageous in that they can be used to record images on various recording materials, in that printers for the methods are inexpensive and compact, and in that the methods are very quiet.

Resolution of ink jet printers has been increasing in recent years, and it has become possible to obtain "photorealistic" recorded matter with high image quality. Along with such improvements in the ink jet printers, various kinds of ink jet recording sheets have been developed.

Characteristics required for these ink jet printing sheets are generally the following items: (1) rapid drying (rapid ink-absorbing speed), (2) proper and uniform diameter of ink dots (no bleeding), (3) good granularity, (4) high circularity of dots, (5) high color density, (6) high chroma (being free of dullness), (7) good water resistance, light fastness and ozone resistance of printed portions, (8) high brightness of recording sheets, (9) good storability of recording sheets (no yellowing or bleeding of images even in long-term storage (excellent in prevention of bleeding over time), (10) substantially no deformation with good dimensional stability (sufficiently small curling), and (11) good running property in ink jet printers.

To use the ink jet recording sheets as photographic glossy paper sheets for obtaining photorealistic high-quality printed matter, the recording sheets are also required to have glossiness, surface smoothness and texture of printed paper sheets resembling that of silver salt photographs as well as the aforementioned characteristics.

An ink jet recording medium with an ink receiving layer having a porous structure has been developed and put into practice in recent years to improve the aforementioned characteristics. Such an ink jet recording medium has excellent ink receptivity (rapid drying ability) due to the porous structure, and high glossiness.

Moreover, use of organic acid has been proposed to improve image storability such as light fastness and gas resistance, and storability of recording sheets (for example, see Japanese Patent Application Laid-Open (JP-A) Nos. 2001-191639, H10-193779, H10-264506 and H06-316145). However, it has become clear that inclusion of organic acid in an image receiving layer results in formation of an image with decreased density.

Improvement of image storability and storability of recording sheets, and prevention of a decrease in color forming density are required for not only ink-jet recording media having an ink receiving layer, but also for digital electrophotographic recording media having a toner receiving layer, sublimation transfer recording media having a sublimation transfer image receiving layer, heat-sensitive recording medium having a heat-sensitive color-forming layer, and thermal transfer recording media having a thermal transfer image receiving layer.

Accordingly, there is a need for an image recording medium that has high storability and on which an image with high storability and high density can be formed and for a method for manufacturing such an image recording medium.

SUMMARY OF THE INVENTION

A first aspect of the invention provides a recording medium containing a compound shown by the following Formula (1).

$$(Y^1)_n—Z^1—(X)_l—Z^2—(Y^1)_m \qquad \text{Formula (1)}$$

In Formula (1), each of $Z^1$ and $Z^2$ indicates a substituted or unsubstituted aromatic ring which may have at least one hetero atom; X indicates —O—, —S—, —S—S—, or —$C(R)_2$—; R indicates an alkyl group or a hydrogen atom; each of $Y^1$ and $Y^2$ indicates a sulfo group, a carboxyl group, a phosphono group, a carbonamide group, a sulfonamide group, or a quaternary ammonium salt; l indicates 0 or 1; and each of m and n indicates 0 or an integer of 1 or more, and at least one of m and n is an integer of 1 or more.

Moreover, a second aspect of the invention provides a method for manufacturing the recording medium according to claim 1, including: applying a coating liquid containing fine particles and a water-soluble binder to form a coated layer, and applying a basic solution having pH of 7.1 or more to the coated layer to cross-link and harden the coated layer to form a recording layer, wherein at least one of the coating liquid and the basic solution contains a cross-linking agent, and the applying basic solution to the coated layer is conducted at the same time as the formation of the coated layer, or at the time when the coated layer is drying and before the coated layer exhibits falling-rate drying.

DETAILED DESCRIPTION OF THE INVENTION

The recording medium of the invention is for use in ink-jet recording, digital electrophotographic recording, sublimation transfer recording, heat-sensitive recording, and thermal transfer recording methods, and contains at least one compound shown by the following Formula (1).

$$(Y^1)_n—Z^1—(X)_l—Z^2—(Y^2)_m \qquad \text{Formula (1)}$$

In Formula (1), each of $Z^1$ and $Z^2$ indicates a substituted or unsubstituted aromatic ring which may have at least one hetero atom; X indicates —O—, —S—, —S—S—, or —$C(R)_2$—; R indicates an alkyl group or a hydrogen atom; each of $Y^1$ and $Y^2$ indicates a sulfo group, a carboxyl group, a phosphono group, a carbonamide group, a sulfonamide group, or a quaternary ammonium salt; l indicates 0 or 1; and each of m and n indicates 0 or an integer of 1 or more, and at least one of m and n is an integer of 1 or more.

$Z^1$ and $Z^2$ may be the same or different. $Y^1$ and $Y^2$ may also be the same or different, when both m and n are integers of 1 or more. Preferably, $Z^1$ is the same as $Z^2$ and/or $Y^1$ is the same as $Y^2$ from the viewpoints of easiness of synthesis and supply of such a compound. More preferably, $Z^1$ is the same as $Z^2$ and $Y^1$ is the same as $Y^2$. Moreover, when n is 2 or more, plural $Y^1$s may be the same or different. Also, when m is 2 or more, plural $Y^2$s may be the same or different. When l is 0, $Z^1$ directly bonds with $Z^2$.

The aromatic ring shown by $Z^1$ or $Z^2$ in Formula (1) may be an aromatic hydrocarbon ring or an aromatic hetero-ring containing at least one hetero atom, or may be a condensed aromatic ring.

Each of the at least one hetero atom contained in the aromatic ring may be a nitrogen atom, an oxygen atom, a sulfur atom, a boron atom, a silicon atom, or a phosphorus atom. Among them, the aromatic ring preferably contains at least one nitrogen atom as the at least one hetero atom to prevent a decrease in the density of color.

Examples of the aromatic ring include benzene, naphthalene, anthracene, pyridine, pyrimidine, pyrazine, triazine, and quinoline. Among them, the aromatic ring is preferably benzene, pyridine, pyrimidine, quinoline, or naphthalene, and more preferably benzene, pyridine, pyrimidine, or quinoline.

Moreover, each of the at least one substituent of the substituted aromatic ring is, for example, an alkyl group, an aryl group, an aralkyl group, a heterocyclic group, an aryloxy group, a hydroxyl group, an amino group (containing an anilino group and a heterocyclic amino group), an acyl group, an acylamino group, an ureido group, a halogen atom, a sulfamoyl group, a carbamoyl group, a sulfonyl group, or a sulfonyl group. Among them, the substituted aromatic ring preferably contains at least one of alkyl, hydroxyl, and amino groups, and halogen atoms as the at least one substituent.

In $—C(R)_2—$ shown by X in Formula (1), two Rs may be the same or different. The alkyl group shown by R may be linear or branched, and may have at least one substituent or may be unsubstituted. The alkyl group preferably has 1 to 5 carbon atoms in total, and more preferably 1 to 3 carbon atoms in total. Specific examples thereof include a methyl group, an ethyl group, a propyl group, an isopropyl group, a butyl group, an isobutyl group, a t-butyl group, a pentyl group, a methyl alcohol group, an ethyl alcohol group, a propyl alcohol group, an isopropyl alcohol group, and a butyl alcohol group. Among them, the alkyl group is preferably a methyl group, an ethyl group, a propyl group, a methyl alcohol group, or an ethyl alcohol group.

As for $(X)_l$, l is 0 or 1, and X is preferably —S—S—.

In Formula (1), each of $Y^1$ and $Y^2$ indicates a sulfo group, a carboxyl group, a phosphono group, a carbonamide group, a sulfonamide group, or quaternary ammonium salt, as aforementioned. Hereinafter, these substituents are comprehensively referred to as "water-soluble substituents in the invention".

Among these, the compound represented by Formula (1) preferably contains, as at least one of $Y^1$ and $Y^2$, a sulfo group, a carboxyl group, a carbonamide group, or a sulfonamide group, more preferably a sulfo group or a carboxyl group, and most preferably a sulfo group.

Moreover, the water-soluble substituent in the invention may be in the form of a salt. In this case, there is no particular limit to the counter cation, and examples thereof include alkali metal cations, an ammonium group, and organic cations (e.g., tetramethylammonium, guanidinium, and pyridinium). Among them, the counter cation is preferably an alkali metal cation or an ammonium group, more preferably a lithium, potassium, sodium, or ammonium cation, and most preferably an ammonium cation.

The water-soluble substituent in the invention may be bonded with the corresponding one of the aromatic rings shown by $Z^1$ and $Z^2$ via a bonding group. That is, each of $Y^1$ and $Y^2$ may be shown by the following Formula (2).

$$—W—Y^3 \qquad \text{Formula (2)}$$

In Formula (2), W indicates a bivalent bonding group, and $Y^3$ indicates the water-soluble substituent in the invention.

In Formula (2), typical examples of the water-soluble substituent shown by $Y^3$ in the invention are the same as the aforementioned.

There is no particular limit to the bonding group shown by W. The bonding group may be an ether bond, a thioether bond, or an amide bond. Specific examples thereof include $—OCH_2—$, $—O(CH_2)_2—$, $—O(CH_2)_3—$, $—O(CH_2)_4—$, and $—SCH_2—$.

Moreover, there is no particular limit to the counter cation of the water-soluble substituent in the invention. Examples thereof include alkali metal cations, an ammonium cation, and organic cations (e.g., tetramethylammonium, guanidinium, and pyridinium cations). Among them, the counter cation is preferably an alkali metal cation or an ammonium cation, more preferably a lithium, potassium, sodium, or ammonium cation, and most preferably an ammonium cation.

In Formula (1), at least one of n and m is an integer of 1 or more. That is, it is necessary that at least one of the aromatic rings represented by $Z^1$ and $Z^2$ contain, as at least one substituent, at least one of the aforementioned water-soluble substituents. Each of n and m is preferably an integer of 1 or more in terms of good water solubility of the compound represented by Formula (1).

Specific examples of the compound shown by Formula (1) are shown below, but the invention should not be limited by these compounds.

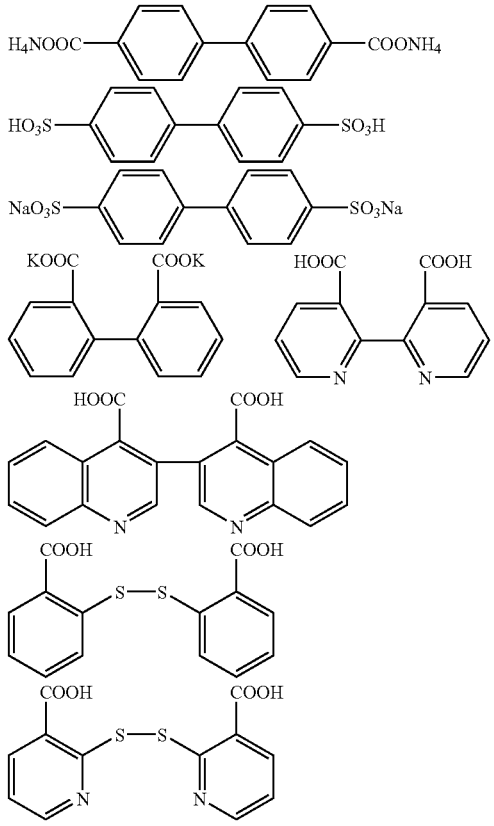

-continued

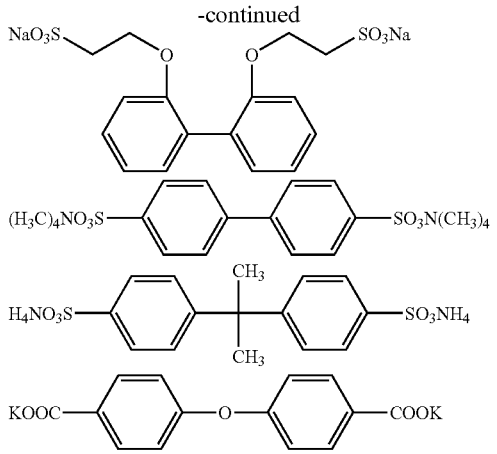

The recording medium of the invention preferably has at least one recording layer including the compound shown by Formula (1) to exhibit the effect of the invention more notably.

Moreover, the amount of the compound shown by Formula (1) in the recording medium of the invention is preferably 0.01 to 5 g/m$^2$, more preferably 0.01 to 3 g/m$^2$, and still more preferably 0.01 to 1 g/m$^2$. When the amount is too small, sufficient image storability may not be obtained. When the amount is too large, such a recording medium may yellow.

<<Recording Medium>>

The recording medium of the invention preferably has at least one recording layer that is suitable for the application thereof such as ink jet recording, digital electrophotographic recording, sublimation transfer recording, heat-sensitive recording, and thermal transfer recording and that contains at least one compound represented by Formula (1).

<Ink Jet Recording Medium>

First, a recording medium having, as a recording layer, an ink receiving layer which is provided to receive an ink for ink jet recording (hereinafter, referred to as "ink jet recording medium") will be described in detail. Containing the compound represented by Formula (1) in the ink jet recording medium, especially in the ink receiving layer, can realize good image storability, good storability of the recording medium itself, and high image density.

Ink Receiving Layer

The ink receiving layer preferably contains at least one water-soluble resin or binder, at least one cross-linking agent capable of cross-linking the water-soluble resin or binder, and fine particles, and may further contain other component(s) such as at least one mordant or at least one surfactant, if necessary.

Water-Soluble Resin or Binder

The ink receiving layer of the recording medium of the invention preferably contains the water-soluble resin or binder.

Examples of the water-soluble resin or binder include polyvinyl alcohol resins, which have at least one hydroxyl group as at least one hydrophilic structural unit, such as polyvinyl alcohol (PVA), acetoacetyl-modified polyvinyl alcohol, cation-modified polyvinyl alcohol, anion-modified polyvinyl alcohol, silanol-modified polyvinyl alcohol and polyvinyl acetal; cellulose resins such as methyl cellulose (MC), ethyl cellulose (EC), hydroxyethyl cellulose (HEC), carboxymethyl cellulose (CMC), hydroxypropyl cellulose (HPC), hydroxyethyl methyl cellulose, and hydroxypropyl methyl cellulose; chitins; chitosans; starch; resins having ether bonds such as polyethylene oxide (PEO), polypropylene oxide (PPO), polyethylene glycol (PEG), and polyvinyl ether (PVE); and resins having at least one carbamoyl group such as polyacrylamide (PAAM), polyvinyl pyrolidone (PVP), and hydrazide polyacrylate.

Alternatively, the water-soluble binder may also be one of gelatin, alginate, maleic acid resin, and polyacrylate each having at least one carboxyl group as at least one dissociating group.

Among these, the water-soluble binder is preferably selected from polyvinyl alcohol resins, cellulose resins, resins having ether bonds, resins having at least one carbamoyl group, resins having at least one carboxyl group, and gelatins, and more preferably polyvinyl alcohol (PVA) resin.

Examples of the polyvinyl alcohol resin include those described in Japanese Patent Application Publication (JP-B) Nos. H04-52786, H05-67432, and H07-29479, Japanese Patent No. 2537827, JP-B No. H07-57553, Japanese Patent Nos. 2502998 and 3053231, JP-A No. S63-176173, Japanese Patent No. 2604367, JP-A Nos. H07-276787, H09-207425, H11-58941, 2000-135858, 2001-205924, 2001-287444, S62-278080, H09-39373, Japanese Patent No. 2750433, and JP-A Nos. 2000-158801, 2001-213045, 2001-328345, H08-324105, H11-348417, S58-181687, H10-259213, 2001-72711, 2002-103805, 2000-63427, 2002-308928, 2001-205919, and 2002-264489.

Moreover, examples of water-soluble resins other than polyvinyl alcohol resins include compounds described in the paragraphs [0011] to [0012] in JP-A No. H11-165461 and compounds described in JP-A Nos. 2001-205919 and 2002-264489.

One of those water-soluble resins may be used alone, or two or more of them can be used together. The content of the water-soluble resin(s) in the solid matter contained in each of the at least one ink receiving layer is preferably 9 to 40% by mass, and more preferably 12 to 33% mass.

In ink jet recording, an ink receiving layer that is porous rapidly absorbs ink due to capillary action and can form dots having good circularity without ink feathering.

Fine Particles

The ink receiving layer in the invention preferably includes fine particles. When the ink receiving layer includes the fine particles, the ink receiving layer has a porous structure and, as a result, has improved ability of absorbing ink. In particular, the content of the fine particles in the solid matter contained in the ink receiving layer is 50% by mass or more, and more preferably over 60% by mass. In this case, the ink receiving layer has a good porous structure, and has more improved ability of absorbing ink. Here, the content of the fine particles in the solid matter contained in the ink receiving layer means the content calculated on the basis of components of the composition of the ink receiving layer that are other than water.

The fine particles that can be used in the invention may be organic and/or inorganic fine particles. However, the fine particles are preferably inorganic fine particles from the viewpoints of a good ink absorbing property and good image stability.

Organic fine particles can be obtained by emulsion polymerization, micro-emulsion polymerization, soap-free polymerization, seed polymerization, dispersion polymerization, or suspension polymerization. Specific examples thereof include powders, latexes and emulsions including fine particles of polyethylene, polypropylene, polystyrene, polyacrylate, polyamide, silicone resin, phenolic resin, and natural polymers.

The average diameter of the organic fine particles is preferably 10 μm or less, and more preferably 0.2 μm or less.

Examples of the inorganic fine particles include silica fine particles, colloidal silica, and fine particles of titanium dioxide, barium sulfate, calcium silicate, zeolite, kaolinite, halloysite, mica, talc, calcium carbonate, magnesium carbonate, calcium sulfate, pseudoboehmite, zinc oxide, zinc hydroxide, alumina, aluminum silicate, calcium silicate, magnesium silicate, zirconium oxide, zirconium hydroxide, cerium oxide, lanthanum oxide, and yttrium oxide. To form a good porous structure, the inorganic fine particles preferably include silica fine particles, colloidal silica, alumina fine particles, or pseudo-boehmite fine particles, or a mixture of at least two types of these. Fine particles that are primary particles may be used as they are. Alternatively, secondary particles, which are agglomerates of primary particles, may also be used. The average primary particle diameter of the fine particles is preferably 2 μm or less, and more preferably 200 nm or less.

More specifically, the inorganic fine particles are preferably silica fine particles with an average primary particle diameter of 30 nm or less, colloidal silica with an average primary particle diameter of 30 nm or less, alumina fine particles with an average primary particle diameter of 20 nm or less, or pseudo-boehmite with an average pore radius of 2 to 15 nm, and more preferably the silica fine particles, the alumina fine particles, or the pseudo-boehmite.

In general, silica fine particles are roughly classified according to their production methods into those produced by wet methods and those produced by dry methods (i.e., gas phase methods). The main method among the wet methods is as follows. Silicate is decomposed with acid to generate activated silica, and the activated silica is moderately polymerized, aggregated and precipitated to form hydrated silica. In contrast, the following gas phase methods are mainly conducted, and anhydrous silica particles are thereby produced. In a flame hydrolysis method, silicon halide is hydrolyzed in a gas phase at a high temperature. In an arc method, quartz sand and coke are heated, reduced and vaporized with arc in an electric furnace and the resultant vaporized matter is oxidized with air. "Vapor phase process silica" means anhydrous silica fine particles produced by the gas phase methods. When the recording medium of the invention includes silica fine particles, the silica fine particles are preferably the vapor phase process silica fine particles.

The vapor phase process silica is different from the hydrated silica in terms of the density of silanol groups on the surface thereof, and the presence or absence of voids therein, and properties. The vapor phase process silica is suitable for forming a three-dimensional structure that has a high percentage of void. The reason for this has not become clear, but is supposedly thought to be as follows. The hydrated silica fine particles have silanol groups on the surfaces thereof at a high density, and, specifically, 5 to 8 silanol groups per $nm^2$ of the surfaces. Thus, the hydrated silica fine particles easily, densely aggregate. Meanwhile, the vapor phase process silica particles have silanol groups on the surfaces thereof at a low density, and, specifically, 2 to 3 silanol groups per $nm^2$ of the surfaces. Therefore, the vapor phase process silica particles loosely flocculate, consequently allowing the ink receiving layer to have a structure with a high percentage of void.

Moreover, the vapor phase process silica has a particularly large specific surface area, and therefore has a high ability of absorbing ink and high retention efficiency. In addition, the vapor phase process silica has a low refractive index. Therefore, when the vapor phase process silica particles are dispersed in the ink receiving layer to a suitable particle diameter, the ink receiving layer can be transparent and may have a good color-forming property and enables formation of images with a high color density. To obtain a high color density and good color-forming gloss, the ink receiving layer being transparent is important. This is true, when the recording medium of the invention is used as photographic glossy paper as well as a recording medium that is required to be transparent, such as an overhead projector (OHP) sheet.

The average primary particle diameter of the vapor phase process silica particles is preferably 30 nm or less, more preferably 20 nm or less, still more preferably 10 nm or less, and most preferably 3 to 10 nm. The vapor phase process silica particles easily adhere to each other due to hydrogen bond between their silanol groups, and, when the average primary particle diameter is 30 nm or less, allows the ink receiving layer to have a structure with a high percentage of void and can effectively improve the ink absorbing property of the ink receiving layer.

The vapor phase process silica particles can be used together with other fine particles selected from those described above. When the vapor phase process silica particles are used together with other fine particles, the content of the vapor phase process silica particles in all the fine particles is preferably 30% by mass or more, and more preferably 50% by mass or more.

The inorganic fine particles that can be used in the invention are also preferably made of alumina hydrate, or a mixture, complex or composite matter of alumina fine particles and alumina hydrate. Alumina hydrate is preferable, since it absorbs and holds ink well. The alumina hydrate is preferably pseudo-boemite ($Al_2O_3.nH_2O$). The alumina hydrate may be used in various forms. It is preferable that boehmite in a sol state is used as the starting material of the alumina hydrate, so as to easily form a smooth layer.

As for the pore structure of the pseudo-boemite, the average pore radius of the pseudo-boemite is preferably 1 to 30 nm, and more preferably 2 to 15 nm. The pore volume thereof is preferably 0.3 to 2.0 ml/g, and more preferably 0.5 to 1.5 ml/g. The average pore radius and the pore volume are measured by a nitrogen adsorption/desorption method. For example, these values are measured with a gas adsorption/desorption analyzer (e.g., OMNISORP 369 manufactured by Beckman Coulter, Inc.).

The alumina fine particles are preferably gas phase process alumina fine particles due to their large surface area. The average primary particle diameter of the gas phase process alumina fine particles is preferably 30 nm or less, and more preferably 20 nm or less.

When the fine particles are contained in the ink jet recording medium, the fine particles are preferably used in the same manner as those disclosed in JP-A No. H10-81064, H10-119423, H10-157277, H10-217601, H11-348409, 2001-138621, 2000-43401, 2000-211235, 2000-309157, 2001-96897, 2001-138627, H11-91242, H08-2087, H08-2090, H08-2091, H08-2093, H08-174992, H11-192777, or 2001-301314.

The ink receiving layer in the invention may include one or more of the aforementioned water-soluble binders and one or more types of the fine particles.

The type of the water-soluble binder to be used together with the fine particles, particularly silica fine particles, is important in obtaining a transparent ink receiving layer. When the recording medium of the invention includes the vapor phase process silica, the water-soluble binder to be also contained in the recording medium is preferably polyvinyl alcohol resin. The saponification degree of the polyvinyl alcohol resin is preferably 70 to 100%, and more preferably 80 to 99.5%.

The polyvinyl alcohol resin has at least one hydroxyl group in the structural unit thereof, and the at least one hydroxyl group and the silanol groups on the surface of the silica fine particles form hydrogen bonds. Therefore, combined use of the polyvinyl alcohol resin and the silica fine particles easily form a three-dimensional network structure having secondary particles of the silica fine particles as a network chain unit. It is thought that an ink receiving layer having a porous structure with a high percentage of void and sufficient strength can be formed by the formation of this three-dimensional network structure.

In ink jet recording, such a porous ink receiving layer can rapidly absorb ink due to capillary action and enables formation of dots having good circularity without ink feathering.

The polyvinyl alcohol resin may be used together with other water-soluble binder(s) selected from those described previously. When the polyvinyl alcohol resin is used together with other water-soluble binder(s), the content of the polyvinyl alcohol resin in all the water-soluble binders is preferably 50% by mass or more, and more preferably 70% by mass or more.

Ratio of Fine Particles to Water-Soluble Binder

The mass ratio of the fine particles (x) to the water-soluble binder(s) (y) [PB ratio (x/y)] gives a great influence on the structure and strength of the ink receiving layer. More specifically, as the mass ratio (PB ratio) increases, the percentage of void, the pore volume, and the surface area (per unit mass) of the ink receiving layer increases, but the density and the strength of the ink receiving layer tend to decrease.

The mass ratio [PB ratio (x/y)] in the ink receiving layer in the invention is preferably 1.5 to 10 so as to avoid decreased strength and generation of cracks at the time of drying, which are caused by the PB ratio being too large, and prevent the binder from easily closing up voids and avoid decreased percentage of void and decreased ink absorbing property, which are caused by the PB ratio being too small.

When a recording medium is being conveyed along the conveyance path of an ink jet printer, stress may be applied to the recording medium. Therefore, it is necessary that the ink receiving layer of the recording medium have sufficient strength. The ink receiving layer having sufficient strength is also necessary to prevent the ink receiving layer from peeling off or cracking at the time when the recording medium is cut into sheets. Considering these, the mass ratio (x/y) is more preferably 5 or less, but, to ensure a high-speed ink absorbing property in an ink jet printer, more preferably 2 or more.

For example, a three-dimensional network structure where secondary particles of silica fine particles serve as a network chain unit and that is a light-transmitting porous film having an average pore diameter of 30 nm or less, a percentage of void of 50 to 80%, a pore specific volume of 0.5 ml/g or more and a specific surface area of 100 $m^2/g$ or more can be easily formed by applying a coating liquid in which vapor phase process silica fine particles having an average primary particle diameter of 20 nm or less and a water-soluble binder are completely dispersed in an aqueous solution at a mass ratio (x/y) of 2 to 5 to a substrate and drying the applied layer.

Cross-Linking Agent

In forming the ink receiving layer of the recording medium of the invention, the coating liquid preferably contains at least one water-soluble binder and at least one cross-linking agent to cross-link the water-soluble binder(s). More preferably, the ink receiving layer is preferably a porous film obtained by applying a coating liquid containing fine particles, at least one water-soluble binder and at least one cross-linking agent to a substrate and cross-linking and curing the at least one water-soluble binder and the at least one cross-linking agent.

The cross-linking agent to cross-link the water soluble binder, especially polyvinyl alcohol, is preferably a boron compound. Examples of the boron compound include borax; boric acid; borates such as orthoborates, $InBO_3$, $ScBO_3$, $YBO_3$, $LaBO_3$, $Mg_3(BO_3)_2$, and $Co_3(BO_3)_2$; diborates such as $Mg_2B_2O_5$, and $Co_2B_2O_5$; metaborates such as $LiBO_2$, $Ca(BO_2)_2$, $NaBO_2$, and $KBO_2$; tetraborates such as $Na_2B_4O_7.10H_2O$; and pentaborates such as $KB_5O_8.4H_2O$, $Ca_2B_6O_{11}.7H_2O$, and $CsB_5O_5$. Among them, the boron compound is preferably borax, boric acid or borate, and more preferably boric acid, since they can promptly cause cross-linking reaction.

The cross-linking agent to cross-link the water soluble binder can also be one of the following compounds other than the boron compound.

Examples of such cross-linking agents include aldehyde compounds such as formaldehyde, glyoxal and glutaraldehyde; ketone compounds such as diacetyl and cyclopentanedione; active halogen compounds such as bis(2-chloroethylurea)-2-hydroxy-4,6-dichloro-1,3,5-triazine and sodium salt of 2,4-dichloro-6-S-triazine; active vinyl compounds such as divinylsulfonic acid, 1,3-vinylsulfonyl-2-propanol, N,N'-ethylenebis(vinylsulfonylacetamide) and 1,3,5-triacryloyl-hexahydro-S-triazine; N-methylol compounds such as dimethylolurea and methylol dimethylhydantoin; melamine resins such as methylolmelamine and alkylated methylolmelamine; epoxy resins; isocyanate compounds such as 1,6-hexamethylenediisocyanate; aziridine compounds such as those described in U.S. Pat. Nos. 3,017,280 and 2,983,611; carboxyimide compounds such as those described in U.S. Pat. No. 3,100,704; epoxy compounds such as glycerol triglycidyl ether; ethyleneimino compounds such as 1,6-hexamethylene-N,N'-bisethylene urea; halogenated carboxyaldehyde compounds such as mucochloric acid and mucophenoxychloric acid; dioxane compounds such as 2,3-dihydroxydioxane; metal-containing compounds such as titanium lactate, aluminum sulfate, chromium alum, potassium alum, zirconyl acetate and chromium acetate; polyamine compounds such as tetraethylene pentamine; hydrazide compounds such as adipic acid hydrazide; and low molecular compounds and polymers containing at least two oxazoline groups.

One of these cross-linking agents may be used alone, or two or more of them can be used together.

In the invention, the cross-linking and curing is preferably performed as follows. At least one cross-linking agent is added to a coating liquid containing fine particles and at least one water-soluble binder (hereinafter, referred to as "coating liquid A" in some cases) and/or to a basic solution having pH of 7.1 or more (hereinafter, referred to as "coating liquid B" in some cases). A coated layer is formed by applying the coating liquid A to a substrate. The basic solution is applied to the coated layer. Here, the application of the basic solution is conducted (1) at the same time as the formation of the coated layer (application of the coating liquid A), or (2) at the time when the coated layer is drying and before the coated layer exhibits falling-rate drying. The pH of the basic solution is preferably 7.5 or more, and more preferably 8 or more.

For example, a boric compound serving as a cross-linking agent is preferably applied to the coated layer as follows. When an ink receiving layer is formed by applying a coating liquid containing fine particles, polyvinyl alcohol, and other water-soluble binder (coating liquid A) to a substrate and cross-linking and curing the resultant coated layer, the cross-linking and curing is performed by applying a basic solution having pH of 7.1 or more (coating liquid B) to the coated layer (1) at the same time as the application of the coating liquid A to form the coated layer or (2) at the time when the coated layer is drying and before the coated layer exhibits falling-rate drying. The boric compound, which is a cross-linking agent, may be contained in at least one of the coating liquid A and the coating liquid B.

The amount of the cross-linking agent(s) is preferably 1 to 50 parts by mass relative to 100 parts by mass of the water-soluble binder(s), and more preferably 5 to 40 parts by mass.

Mordant

In the invention, the ink receiving layer may contain at least one mordant to improve water resistance and feathering resistance over time of an image formed. Each of the at least one mordant is preferably a cationic polymer (cationic mordant), which is an organic mordant, or an inorganic mordant. The ink receiving layer including the mordant has interaction between the mordant and a liquid ink having an anionic dye as a coloring material to stabilize the coloring material, resulting in improved water resistance and feathering resistance over time of an image. One or more of organic mordants or inorganic mordants may be used in the invention. Alternatively, at least one organic mordant and at least one inorganic mordant may be used together.

The at least one mordant may be added to a coating liquid A containing fine particles and at least one water-soluble binder. When the mordant and the fine particles may aggregate, the mordant can be added to a coating liquid B.

The cationic mordant is preferably a polymer mordant having at least one of primary, secondary and tertiary amino groups and quaternary ammonium base as the cationic group(s) thereof. Alternatively, the cationic mordant may be a cationic non-polymer mordant.

The polymer mordant is preferably a homopolymer of a monomer (mordant monomer) having at least one of primary to tertiary amino groups and salts thereof, and quaternary ammonium base; or a copolymer or condensed polymer of the mordant monomer(s) and other monomer(s) (hereinafter, referred to as "non-mordant monomer"). The polymer mordant can be used in the form of a water-soluble polymer or water-dispersible latex particles.

Examples of the mordant monomer include trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethy-N-n-propyl-N-p-vinylbenzyl ammonium chloride, N,N-dimethy-N-n-octyl-N-p-vinylbenzyl ammonium chloride, N,N-dimethy-N-benzyl-N-p-vinylbenzyl ammonium chloride, N,N-diethyl-N-benzyl-N-p-vinylbenzyl ammonium chloride, N,N-dimethyl-N-(4-methyl)benzyl-N-p-vinylbenzyl ammonium chloride, N,N-dimethy-N-phenyl-N-p-vinylbenzyl ammonium chloride; trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl)ethyl ammonium chloride, and N,N-diethyl-N-methyl-N-2-(4-vinylphenyl)ethyl ammonium acetate; quaternary compounds of methylchloride, ethylchloride, methylbromide, ethylbromide, methyl iodide, or ethyliodide and N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl(meth)acrylamide, N,N-dimethylaminopropyl(meth)acrylamide, N,N-diethylaminopropyl(meth)acrylamide; and sulfonates, alkylsulfonates, acetates and alkylcarboxylates obtained by substituting the anion of each of the above-described compounds with sulfonate, alkylsulfonate, acetate or alkylcarboxylate.

More specifically, the mordant monomer can be one of monomethyl diallyl ammonium chloride, trimethyl-2-(methacryloyloxy)ethyl ammonium chloride, triethyl-2-(methacryloyloxy)ethyl ammonium chloride, trimethyl-2-(acryloyloxy)ethyl ammonium chloride, triethyl-2-(acryloyloxy) ethyl ammonium chloride, trimethy-3-(methacryloyloxy) propyl ammonium chloride, triethyl-3-(methacryloyloxy) propyl ammonium chloride, trimethyl-2-(methacryloyamino)ethyl ammonium chloride, triethyl-2-(methacryloylamino)ethyl ammoniumchloride, trimethyl-2-(acryloylamino)ethyl ammoniumchloride, triethyl-2-(acryloylamino)ethyl ammonium chloride, trimethyl-3-(methacryloyamino)propyl ammonium chloride, triethyl-3-(methacryloylamino)propyl ammonium chloride, trimethyl-3-(acryloylamino)propyl ammonium chloride, triethyl-3-(acryloylamino)propyl ammonium chloride, N,N-dimethyl-N-ethyl-2-(methacryloyloxy)ethyl ammonium chloride, N,N-diethyl-N-methyl-2-(methacryloyloxy)ethyl ammonium chloride, N,N-dimethyl-N-ethyl-3-(acryloylamino) propyl ammonium chloride, trimethyl-2-(methacryloyloxy) ethyl ammonium bromide, trimethyl-3-(acryloylamino) propyl ammonium bromide, trimethyl-2-(methacryloyloxy) ethyl ammonium sulfonate, and trimethyl-3-(acryloylamino) propyl ammonium acetate. A copolymerizable monomer may be N-vinylimidazole or N-vinyl-2-methyimidazole.

Moreover, the mordant monomer may also be allylamine, diallylamine, or a derivative or salt thereof. Examples of these compounds include allylamine, allylamine hydrochloride, allylamine acetate, allylamine sulfate, diallylmethylamine and salts thereof (e.g., hydrochloride salt, acetate salt, and sulfate salt), diallylethylamine and salts thereof (e.g., hydrochloride salt, acetate salt, and sulfate salt), and diallydimethylammonium salts (the counter anion of each of the salts being, for example, chloride, an acetate ion, and a sulfate ion). Because the polymerizing properties of the allylamine and diallylamine derivatives that are in the forms of amines are poor, the salt of each of these compounds is generally used in polymerization, and, if necessary, the product obtained by the polymerization is desalted. Alternatively, a product obtained by polymerizing at least one of N-vinylacetamide and N-vinylformamide, and hydrolyzing the resultant to convert its vinylamide moieties to vinylamine units can be used as the polymer mordant. Also, a product having salts derived from the vinylamine units may be used as the polymer mordant.

The non-mordant monomer means a monomer that does not contain a basic or cationic part such as a primary, secondary, or tertiary amino group or a salt thereof, or quaternary ammonium base, and that does not or hardly interact with the dye(s) contained in an ink for ink jet recording.

Examples of the non-mordant monomer include alkyl (meth)acrylates; cycloalkyl(meth)acrylates such as cyclohexyl(meth)acrylate; aryl(meth)acrylates such as phenyl (meth)acrylate; aralkyl(meth)acrylates such as benzyl(meth) acrylate; aromatic vinyl compounds such as styrene, vinyl toluene, and α-methyl styrene; vinyl esters such as vinyl acetate, vinyl propionate, and vinyl versatate; allyl esters such as allyl acetate; compounds containing at least one halogen atom such as vinylidene chloride and vinyl chloride; vinylcyanides such as (meth)acrylonitrile; and olefins such as ethylene and propylene.

The alkyl(meth)acrylates preferably have 1 to 18 carbon atoms in the alkyl moiety. Examples thereof include methyl (meth)acrylate, ethyl(meth)acrylate, propyl(meth)acrylate, isopropyl(meth)acrylate, n-butyl(meth)acrylate, isobutyl (meth)acrylate, t-butyl(meth)acrylate, hexyl(meth)acrylate, octyl(meth)acrylate, 2-ethylhexyl(meth)acrylate, lauryl (meth)acrylate, and stearyl(meth)acrylate. Among them, the alkyl(meth)acrylate is preferably methyl acrylate, ethyl acrylate, methyl methacrylate, ethyl methacrylate or hydroxyethyl methacrylate.

One of these non-mordant monomers can be used alone, or two or more of them can be used together.

Other preferred examples of the polymer mordant include cyclic amine resins and derivatives thereof (including copolymers) such as polydiallyl dimethyl ammonium chloride, copolymers of diallyl dimethyl ammonium chloride and other monomer(s) (i.e., mordant monomer(s) and/or non-mordant monomer(s)), copolymer of diallyl dimethyl ammonium chloride and $SO_2$, polydiallylmethylamine hydrochloride, and polydiallyl hydrochloride; polymers of alkyl(meth)acrylates having at least one substituent selected from a secondary amino group, a tertiary amino group, and quaternary ammonium salt and copolymers of such alkyl(meth)acrylate(s) and other monomer(s) such as polydiethylmethacryloyloxyethylamine, polytrimethylmethacryloyloxyethyl ammonium chloride, polydimethylbenzylmethacryloyloxyethyl ammonium chloride, and polydimethylhydroxyethylacryloyloxyethyl ammonium chloride; polyamine resins such as polyethyleneimine and derivatives thereof, polyallyamine and derivatives thereof, and polyvinylamine and derivatives thereof; polyamide resins such as polyamide-polyamine resins, and polyamideepichlorohydrin resins; polysaccharides such as cationized starch, chitosan, and chitosan derivatives; dicyandiamide derivatives such as dicyandiamide formaldehyde polycondensates, and dicyandiamide ethylenetriamine polycondensates; polyamidine and polyamidine derivatives; dialkylamine epichlorohydrin addition polymer and derivatives thereof such as dimethylamine epichlorohydrin addition polymer; styrene polymer having at least one alkyl group with a quaternary ammonium salt substituent and copolymers of the styrene polymer and other monomer(s).

Specifically, such polymer mordants are described in, for example, JP-A Nos. S48-28325, S54-74430, S54-124726, S55-22766, S55-142339, S60-23850, S60-23851, S60-23852, S60-23853, S60-57836, S60-60643, S60-118834, S60-122940, S60-122941, S60-122942, S60-235134, and H01-161236, U.S. Pat. Nos. 2,484,430, 2,548,564, 3,148,061, 3,309,690, 4,115,124, 4,124,386, 4,193,800, 4,273,853, 4,282,305, and 4,450,224, JP-A Nos. H01-161236, H10-81064, H10-157277, H10-217601, 2001-138621, 2000-211235, 2001-138627, and H08-174992; JP-B Nos. H05-35162, H05-35163, H05-35164, and H05-88846, and Japanese Patent Nos. 2648847 and 2661677.

As aforementioned, the mordant may also be an inorganic mordant, and the inorganic mordant may be a water-soluble or hydrophobic salt compound of a polyvalent metal ion.

Specifically, the inorganic mordant is, for example, a salt or complex of a metal such as magnesium, aluminium, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten, or bismuth.

Specific examples thereof include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, cupric chloride, cupric ammonium chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, aluminium sulfate, aluminium alum, basic polyhydroxy aluminum, aluminum sulfite, aluminum thiosulfate, poly aluminum chloride, aluminium nitrate nonahydrate, aluminium chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, titanium tetrachloride, tetraisopropyl titanate, titanium acetylacetonate, titanium lactate, zirconium acetylacetonate, zirconyl acetate, zirconyl sulfate, zirconium ammonium carbonate, zirconyl stearate, zirconyl octylate, zirconyl nitrate, zirconium oxychloride, zirconium hydroxychloride, chromium acetate, chromium sulfate, magnesium sulfate, magnesium chloride hexahydrate, magnesium citrate nanohydrate, sodium phosphotungstate, sodium tungsten citrate, 12-tungstophosphate n-hydrate, 12-tungustosilisic acid 26 hydrate, molybdenum chloride, 12-molybdophosphate n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride and bismuth nitrate.

The inorganic mordant is preferably a compound containing aluminum, a compound containing titanium, a compound containing zirconium, or a metallic compound (i.e., a salt or complex) including an element belonging to Group IIIb in the periodic table.

In the invention, the amount of the mordant(s).contained in the ink receiving layer is preferably 0.01 $g/m^2$ to 5 $g/m^2$, and more preferably 0.1 $g/m^2$ to 3 $g/m^2$.

When at least one organic mordant and at least one inorganic mordant are used together, a desired ratio of the at least one organic mordant to the at least one inorganic mordant may be so determined as to obtain well balance between the storability of the recording medium and bleeding. The content of the inorganic mordant(s) in all the mordants is preferably 5% by mass or more, and more preferably 10% by mass or more.

Compounds Having at least Two Kinds of Polyvalent Metal Ions

The recording medium of the invention can contain at least one compound having in the molecule thereof at least two kinds of polyvalent metal ions (hereinafter, referred to as a "compound containing metals" in some cases). Examples of metallic atoms whose ions are polyvalent include all of metallic atoms showing an ionic valency that is polyvalent. There is no particular limit thereto. Specific examples thereof include magnesium, aluminum, calcium, scandium, titanium, vanadium, manganese, iron, nickel, chromium, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten, and bismuth.

The polyvalent metal ions are preferably two kinds or more selected from ions of metallic elements of Groups II to IV in the periodic table.

Examples of metallic elements of Group II include beryllium, magnesium, calcium, strontium, barium, and zinc.

Examples of metallic elements of Group III include scandium, yttrium, lanthanum, boron, aluminum, gallium, indium, and thallium.

Examples of metallic elements of Group IV include titanium, zirconium, hafnium, and thorium.

Among these metallic elements, the polyvalent metal ions in the compound containing metals are preferably at least two kinds of ions of metals selected from aluminum, zirconium, titanium, lanthanoid, zinc, and magnesium, and more preferably combinations of a zirconium ion and at least one kind selected from aluminum, titanium, lanthanoid, zinc and magnesium ions from the viewpoints of the ozone resistance of the recording medium and an improving effect for bleeding over time.

Moreover, the compound having in the molecule at least two kinds of polyvalent metal ions is preferably a water-soluble compound containing metals so as to obtain good production adaptability. Here, the term "water-soluble" means being dissolved in water by 0.5% by mass or more at room temperature. The solubility of the compounds is preferably 1.0% by mass or more, and more preferably 1.5% by mass or more. When the compound is oil-soluble, the compound can be emulsified or dispersed in a solvent to prepare an emulsion or dispersion, or dissolved in a solvent to prepare an organic solution, and the emulsion, dispersion or organic solution may be added to a system. When the compound is solid, the compound is dispersed in a solvent to obtain fine particles and the resultant dispersion can be added to a system.

In order to obtain good balance between ozone resistance and prevention of bleeding over time of the recording medium and remarkably improve the both, the compound containing metals is preferably a composite compound that results from a compound containing zirconium and a compound containing aluminum.

Specific examples of the compound containing zirconium include zirconium acetylacetonate, zirconyl acetate, zirconyl sulfate, zirconium ammonium carbonate, zirconyl stearate, zirconyl octylate, zirconyl nitrate, zirconium oxychloride, zirconium hydroxychloride, zirconyl lactate, zirconyl succinate, zirconyl oxalate, and basic zirconyl glycinate, and mixtures thereof.

Specific examples of the compound containing aluminum include aluminum halides, basic aluminum chloride (poly aluminum chloride), basic aluminum sulfate, basic aluminum nitrate, basic aluminum sulfamate, and basic aluminum phenolsulfonate, and mixtures thereof.

The composite compound containing zirconium and aluminum is preferably a product made with a basic zirconium compound and/or a basic aluminum compound.

The basic zirconium compound that can be used to form the compound containing metals is preferably a compound represented by the following Formula (I).

$$Zr(OH)_xA_{4-x} \qquad \text{Formula (I)}$$

In Formula (I), A indicates amino acid, and x indicates a number that satisfies the inequality of $0<x<4$ and is not necessarily an integer.

The basic zirconium compound represented by Formula (1) is preferably basic zirconium-amino acid gel, zirconium hydroxide-amino acid gel, basic zirconium carbonate-amino acid gel, or a mixture including at least two of these substances. The gel is preferably a reaction product between a water-soluble salt of amino acid and a water-soluble zirconium salt, or between a water-soluble salt of amino acid and a zirconium hydroxy salt.

A zirconium compound is preferably a zirconium oxy salt, a zirconium hydroxy salt, a trioxodizirconyl hydroxy salt, or a mixture including at least two of these salts.

When the basic zirconium compound is a basic zirconium carbonate gel, the basic zirconium carbonate is preferably a compound represented by the following Formula (II).

$$Zr(OH)_{4-2x}(CO_3)_x \qquad \text{Formula (II)}$$

In Formula (II), x indicates a number that satisfies the inequality of $0<x<2$ and is not necessarily an integer.

The basic zirconium carbonate gel shown by Formula (II) is preferably a reaction product between sodium carbonate and a zirconium oxy salt or a zirconium hydroxy salt.

Formulae (I) and (II) are written in simplified expressions, and the compounds represented by these formulae may be polymers of Formulae (I) and (II), and ligands and/or water can be included in the compounds. In Formulae (I) and (II), the OH group may be substituted with an oxide (an oxy group).

An acidic, or cationic zirconium compound that can be used to form the compound containing metals is a zirconium oxy salt or a zirconium hydroxy salt that is also referred to as a zirconium salt or a zirconyl hydroxy salt. Such a compound can be represented by the following Formula (III).

$$ZrO(OH)_{2-nz}B_z \qquad \text{Formula (III)}$$

In Formula (III), z is about 0.9 to 2 and is not necessarily an integer, and n is the valency of B, and these satisfy the inequality of $2-nz>0$. B is selected from the group consisting of halide, nitrate, sulfamate, sulfate, and mixtures thereof.

The basic aluminum compound that can be used to form the compound containing metals can be represented by the following Formula (IV).

$$Al_2(OH)_{6-nx}B_x \qquad \text{Formula (IV)}$$

In Formula (IV), B is selected from the group consisting of halide, nitrate, sulfamate, sulfate, and mixtures thereof, and x indicates the number that satisfies the inequality of $0<x<6$ and is not necessarily an integer, and "6-nx" indicates a number of 0 or more, and n indicates the valency of B.

Formula (IV) indicates a polymer or a complex, a basic aluminum compound containing water coordination and/or combined molecules, and mixtures thereof.

The basic aluminum compound of Formula (IV) is preferably the following basic aluminum chloride that, in Formula (IV), has a chlorine atom as B and the number that satisfies the inequality of $0<x<5$ and that is not necessarily an integer as x.

$$Al_2(OH)_2Cl_4 \text{ to } Al_2(OH)_5Cl$$

In the compound containing zirconium and aluminum, the molar ratio of zirconium to aluminum is preferably 1/100 to 100/1, more preferably 3/100 to 100/3, and most preferably 5/100 to 100/5.

Also, the compound having in the molecule at least two kinds of polyvalent metal ions is preferably a complex resulting from at least one organic compound and the metal ions. The organic compound preferably has at least one kind of oxygen, sulfur, nitrogen, and phosphorus atoms, which have at least one lone pair, so that the organic compound can interact with the metal ions.

Examples of such an organic compound include those having at least one group that can become an anionic group selected from $—CO_2^-$, $—SO_3^-$, $—OSO_3^-$, $—PO_4^{m-}$ (m is an integer of 1 to 3), $—PO_3^{2-}$, $—PO_2^-$, and $—O^-$. The organic compound may further have at least one nitrogen atom as well as the group(s) that can become an anionic group.

Specific examples of the organic compound include amino acid, aliphatic carboxylic acid compounds, betaine compounds (for example, carbobetaine, sulfobetaine, and phosphobetaine compounds), aromatic carboxylic acid compounds, heterocyclic carboxylic acid compounds, aliphatic diketone compounds, aliphatic sulfonic acid compounds, aromatic sulfonic acid compounds, heterocyclic sulfonic acid compounds, aliphatic phosphoric acid compounds, aromatic phosphoric acid compounds, heterocyclic phosphoric acid compounds, aliphatic sulfinic acid compounds, aromatic sulfinic acid compounds, heterocyclic sulfinic acid compounds, amine compounds (e.g., amine compounds containing at least one hydroxy group), amide compounds, and urea compounds.

Each of these may be a low-molecular-weight compound, or may be a high-molecular compound that may have at least one substituent on or in a partial skeleton thereof.

Specific examples of the compound having at least two kinds of polyvalent metal ions are shown below. However, the invention is not limited by these compounds.

(1) zirconium-chloro-glycine-hydroxyaluminum composite material, (2) octaaluminum-zirconium-pentachloride-tricosahydroxiode, (3) tetraaluminum-zirconium-tetrachloride-dodecahydroxide, (4) tetraaluminum-zirconium-trichloride-tridecahydroxide, (5) octaaluminum-zirconium-octachloride-eicosahydroxide, (6) a mixture of basic aluminum chloride ($Al_2(OH)_5Cl$) and zirconium lactate, (7) a composite material of basic aluminum chloride ($Al_2(OH)_5Cl$) and zirconium acetate, (8) a composite material of basic aluminum chloride ($Al_2(OH)_5Cl$) and basic zirconium glycine, (9) a composite material of aluminum chloride, basic zirconium alanine, and zinc sulfate,

(10) a composite material of basic zirconium glycine, lanthanum chloride, and basic aluminum chloride ($Al_2(OH)_5Cl$),

(11) a composite material of basic aluminum chloride ($Al_2(OH)_5Cl$), zirconium oxychloride, and hydroxyethyl iminodiacetic acid,

(12) a composite material of basic aluminum chloride ($Al_2(OH)_5Cl$), zirconium oxychloride, and betaine,

(13) myristato-methacrylato-chlorohydroquiso-methanolato-isopropnanolato-zirconium-aluminum, and

(14) 3-aminopropionato-chlorohydroxo-methanolato-zirconium-aluminum

In producing the ink-jet recording medium of the invention, a compound having in the molecule thereof at least two kinds of polyvalent metal ions may be prepared, and then added to a coating liquid for an ink receiving layer (1). Alternatively, a compound (composite material) having in the molecule thereof at least two kinds of polyvalent metal ions may be produced by simultaneously or separately adding raw materials that can form the compound having in the molecule thereof at least two kinds of polyvalent metal ions, such as a combination of a compound containing zirconium and a compound containing aluminum, to the other components of a coating liquid for an ink receiving layer and/or a mordant coating liquid, and reacting these raw materials to form the composite material in preparing the coating liquid for an ink receiving layer and/or the mordant coating liquid (2).

The compound having in the molecule thereof at least two kinds of polyvalent metal ions can be usually manufactured by mixing raw materials each containing a metal that can form the compound having in the molecule thereof at least two kinds of polyvalent metal ions, and, if necessary, heating the resultant mixture. Each of the raw materials each containing a metal may be a salt obtained by bonding the metal with a strong acid or a weak acid, or may be hydroxide, halohydroxide, or a complex. The composite material formed by reacting these raw materials each containing a metal can be contained in the ink receiving layer of the ink jet recording medium.

Specific examples of such metal salt, hydroxide, halohydroxide, and complex include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, cupric chloride, cupric ammonium chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, aluminum sulfate, aluminum alum, aluminum sulfite, aluminum thiosulfate, poly aluminum chloride, basic aluminum lactate, basic aluminum sulfate, basic aluminum nitrate, basic aluminum sulfamate, basic aluminum formate, basic aluminum acetate, basic aluminum glycinate, aluminum nitrate nonahydrate, aluminum chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, titanium tetrachloride, tetraisopropyltitanate, titanium acetylacetonate, titanium lactate, zirconium acetylacetonate, zirconyl acetate, zirconyl sulfate, zirconium ammonium carbonate, zirconyl stearate, zirconyl octylate, zirconyl nitrate, zirconyl lactate, zirconyl succinate, zirconyl oxalate, zirconium ammonium acetate, potassium zirconium carbonate, zirconium sodium lactate, basic zirconium glycinate, zirconium oxychloride, zirconium hydroxychloride, chromium acetate, chromium sulfate, magnesium sulfate, magnesium chloride hexahydrate, magnesium citrate nonahydrate, sodium phosphotungstate, sodium tungsten citrate, 12 tungstophosphoric acid n hydrate, 12 tungstosilicic acid 26 hydrate, molybdenum chloride, 12 molybdophosphoric acid n hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride, and bismuth nitrate.

The raw material containing a metal is preferably a compound containing aluminum such as aluminum sulfate, aluminum alum, aluminum sulfite, aluminum thiosulfate, poly aluminum chloride, basic aluminum lactate, basic aluminum sulfate, basic aluminum nitrate, basic aluminum sulfamate, basic aluminum formate, basic aluminum acetate, basic aluminum glycinate, aluminum nitrate nonahydrate, or aluminum chloride hexahydrate; a compound containing titanium such as titanium tetrachloride, tetraisopropyltitanate, titanium acetylacetonate, or titanium lactate; or a compound containing zirconium such as zirconium acetylacetonate, zirconyl acetate, zirconyl sulfate, zirconium ammonium carbonate, zirconyl stearate, zirconyl octylate, zirconyl nitrate, zirconyl lactate, zirconyl succinate, zirconyl oxalate, zirconium ammonium acetate, zirconium potassium carbonate, zirconium sodium lactate, basic zirconium glycinate, zirconium oxychloride, or zirconium hydroxychloride, and more preferably a basic zirconium salt or a basic aluminum salt.

In the invention, the amount of the compound(s) having in the molecule thereof at least two kinds of polyvalent metal ions in the ink receiving layer is preferably 0.01 $g/m^2$ to 20 $g/m^2$, more preferably 0.1 $g/m^2$ to 15 $g/m^2$, and most preferably 0.5 $g/m^2$ to 10 $g/m^2$ in order to further improve prevention of image bleeding and light stability of the recording medium.

When the amount of the complex (composite material) is less than 0.01 $g/m^2$, prevention of image bleeding and light stability may be insufficiently improved. When the amount is over 20 $g/m^2$, fine particles, if any, may easily aggregate, and a recording medium with lowered glossiness may be consequently obtained.

Other Components

The recording medium of the invention can further contain at least one of various known additives, such as acids, ultraviolet absorbents, antioxidants, fluorescent brighteners, monomers, polymerization initiators, polymerization inhibitors, bleeding inhibitors, antiseptics, viscosity stabilizers, antifoaming agents, surfactants, antistatic agents, matting agents, curling inhibitors, and waterproofing agents.

In the invention, the ink receiving layer may contain at least one kind of acid. The pH of the surface of the ink receiving layer is adjusted at a value within the range of 3 to 8, and preferably at a value within the range of 4 to 6 due to inclusion of acid therein. This pH adjustment improves yellowing resistance in the white background portion of the recording medium. The pH of the surface is measured by A method (application method), which is one of surface pH measurement methods stipulated by Japan Technical Association of Paper and Pulp Industry (J. TAPPI). For example, the pH of the surface can be measured with MPC FORM that is manufactured by Kyoritsu Chemical-Check Lab., Corp and that is a measurement set for paper corresponding to A method.

Specific examples of the acid include formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, glutaric acid, gluconic acid, lactic acid, aspartic acid, glutamic acid, salicylic acid, metal salicylates (e.g., salts of Zn, Al, Ca, and Mg), methanesulfonic acid, itaconic acid, benzenesulfonic acid, toluenesulfonic acid, trifluoromethanesulfonic acid, styrenesulfonic acid, trifluoroacetic acid, barbituric acid, acrylic acid, methacrylic acid, cinnamic acid, 4-hydroxybenzoic acid, aminobenzoic acid, naphthalenedisulfonic acid, hydroxybenzenesulfonic acid, toluenesulfinic acid, benzenesulfinic acid, sulfanilic acid, sulfamic acid, α-resorcinic acid, β-resorcinic acid, γ-resorcinic acid, gallic acid, phloroglycine, sulfosalicylic acid, ascorbic acid, erythorbic acid, bisphenolic acid, hydrochloric acid, nitric acid, sulfuric acid, phosphoric acid, polyphosphoric acid, boric acid, boronic acid, and acidic ones of the aforementioned organic and inorganic mordants. A desired amount of the acid(s) is so determined as to adjust the pH of the surface of the ink receiving layer at a value within the range of 3 to 8. The acid may be used in the form of a metallic salt (for example, a salt of sodium, potassium, calcium, cesium, zinc, copper, iron, aluminum, zirconium, lanthanum, yttrium, magnesium, strontium, or cerium), or an amine salt (for example, ammonia, triethylamine, triobutylamine, piperazine, 2-methylpiperazine, or polyallylamine).

In the invention, it is preferable that the ink receiving layer contains at least one storability improving agent such as at least one ultraviolet absorbent, at least one antioxidant, and at least one bleeding inhibitor.

Examples of the ultraviolet absorbent, antioxidant, and bleeding inhibitor include alkylated phenol compounds (including hindered phenol compounds), alkylthiomethylphenol compounds, hydroquinone compounds, alkylated hydroquinone compounds, tocopherol compounds, compounds having at least one thioether bond, aromatic and/or heterocyclic compounds, bisphenol compounds, O-, N-, S-benzyl compounds, hydroxybenzyl compounds, triazine compounds, phosphonate compounds, acylaminophenol compounds, ester compounds, amide compounds, ascorbic acid, amine antioxidants, 2-(2-hydroxyphenyl)benzotriazole compound, 2-hydroxybenzophenone compounds, acrylates, water-soluble or hydrophobic metal salts, organic metal compounds, metal complexes, hindered amine compounds (including TEMPO compounds), 2-(2-hydroxyphenyl)1,3,5-triazine compound, metal deactivators, phosphite compounds, phosphonite compounds, hydroxyamine compounds, nitron compound, peroxide scavengers, polyamide stabilizers, polyether compounds, basic auxiliary stabilizers, nuclear agents, benzofuranone compounds, indolinone compounds, phosphine compounds, polyamine compounds, thiourea compounds, urea compounds, hydrazide compounds, amidine compounds, saccharic compounds, hydroxybenzoic acid compounds, dihydroxybenzoic acid compounds, and trihydroxybenzoic compounds.

The ultraviolet absorbent, antioxidant, or bleeding inhibitor is preferably one of alkylated phenol compounds, aliphatic, aromatic and/or heterocyclic compounds having at least one thioether bond, bisphenol compounds, ascorbic acid, amine antioxidants, water-soluble or hydrophobic metal salts, organic metal compounds, metal complexes, hindered amine compounds, hydroxyamine compounds, polyamine compounds, thiourea compounds, hydrazide compounds, hydroxybenzoic acid compounds, dihydroxybenzoic acid compounds, and trihydroxybenzoic compounds.

Specifically, those described in, for example, JP-A Nos. 2002-36717 and 2002-86904, Japanese Patent Application No. 2002-13005, JP-A Nos. H10-182621 and 2001-260519, JP-B Nos. H04-34953 and H04-34513, JP-A No. H11-170686, JP-B No. H04-34512, EP No. 1,138,509, JP-A Nos. S60-67190, H7-276808, 2001-94829, S47-10537, S58-111942, S58-212844, S59-19945, S59-46646, S59-109055, and S63-53544, JP-B Nos. S36-10466, S42-26187, S48-30492, S48-31255, S48-41572, S48-54965, and S50-10726, U.S. Pat. Nos. 2,719,086, 3,707,375, 3,754,919, and 4,220,711, JP-B Nos. S45-4699 and S54-5324, EP Nos. 223,739, 309,401, 309,402, 310,551, 310,552, and 459,416, German Patent Application Laid-Open No. 3,435,443, JP-A Nos. S54-48535, S60-107384, S60-107383, S60-125470, S60-125471, S60-125472, S60-287485, S60-287486, S60-287487, S60-287488, S61-160287, S61-185483, S61-211079, S62-146678, S62-146680, S62-146679, S62-282885, S62-262047, S63-051174, S63-89877, S63-88380, S66-88381, S63-113536, S63-163351, S63-203372, S63-224989, S63-251282, S63-267594, S63-182484, H01-239282, H02-262654, H02-71262, H03-121449, H04-291685, H04-291684, H05-61166, H05-119449, H05-

188687, H05-188686, H05-110490, H05-1108437, and H05-170361, JP-B Nos. S48-43295, and S48-33212, and U.S. Pat. Nos. 4,814,262 and 4,980,275 can be used as such.

One of those other components may be used alone, or two or more of them can be used together. These other components may be added to a system in the form of an aqueous solution, a dispersion, a polymer dispersion, an emulsion, or oil droplets, or may be micro-encapsulated. The amount of such other component(s) in the recording medium of the invention is preferably 0.01 to 10 g/m$^2$.

For the purpose of improving dispersibility of inorganic fine particles, the surfaces of the inorganic particles may be treated with at least one silane coupling agent. The silane coupling agent preferably has at least one organic functional group (for example, a vinyl group, an amino group (i.e., primary to tertiary amino groups, and a quaternary ammonium base), an epoxy group, a mercapto group, a chloro group, an alkyl group, a phenyl group, an ester group, or a thioether group) in addition to the site for performing coupling treatment.

In the invention, a coating liquid for an ink receiving layer preferably includes at least one surfactant. Each of the at least one surfactant may be a cationic, anionic, nonionic, amphoteric, fluorinated, or silicon-containing surfactant.

Typical examples of the nonionic surfactant include polyoxyalkylene alkyl ether and polyoxyalkylene alkyl phenyl ether (such as diethylene glycol monoethyl ether, diethylene glycol diethyl ether, polyoxyethylene lauryl ether, polyoxyethylene stearyl ether and polyoxyethylene nonyl phenyl ether); oxyethylene-oxypropylene block copolymer, sorbitan fatty acid esters (such as sorbitan monolaurate, sorbitan monooleate and sorbitan trioleate); polyoxyethylene sorbitan fatty acid esters (such as polyoxyethylene sorbitan monolaurate, polyoxyethylene sorbitan monoolelate and polyoxyethylene sorbitan trioleate); polyoxyethylene sorbitol fatty acid esters (such as tetraoleic acid polyoxyethylene sorbit); glycerin fatty acid esters (such as glycerol monooleate); polyoxyethylene glycerin fatty acid esters (such as monostearic acid polyoxyethylene glycerin and monooleic acid polyoxyethylene glycerin); polyoxyethylene fatty acid esters (such as polyethylene glycol monolaurate, and polyethylene glycol monooleate); polyoxyethylene alkylamine; and acetylene glycols (such as 2,4,7,9-tetramethyl-5-decyn-4,7-diol, and ethylene oxide adducts and propylene oxide adducts theseof). The nonionic surfactant is preferably polyoxyalkylene alkyl ether. The nonionic surfactant may be contained in both coating liquids A and B. One of those nonionic surfactants may be used alone, or two or more of them can be used together.

Examples of the amphoteric surfactant include amino acid surfactants, carboxyammonium betaine surfactants, sulfonammonium betaine surfactants, ammonium sulfate betaine surfactants, and imidazolium betaine surfactants. For example, those described in U.S. Pat. No. 3,843,368, JP-A Nos. S59-49535, S63-236546, H05-303205, H08-262742, and H10-282619, Japanese Patent Nos. 2514194 and 2759795, and JP-A No. 2000-351269 can be preferably used as such. The amphoteric surfactant is more preferably an amino acid surfactant, a carboxyammonium betaine surfactant, or a sulfonammonium betaine surfactant. One of these amphoteric surfactants may be used alone, or two or more of them can be used together.

Examples of the anionic surfactant include fatty acid salts (for example, sodium stearate and potassium oleate), alkylsulfuric acid esters (for example sodium laurylsulfate and triethanolamine laurylsulfate), sulfonic acid salts (for example, sodium dodecylbenzenesulfonate), alkylsulfosuccinic acid salts (for example, sodium dioctylsulfosuccinate), alkyldiphenyl ether disulfonic acid salts, and alkylphosphoric acid salts.

Examples of the cationic surfactant include alkylamine surfactants, quaternary ammonium salts, pyridinium salts and imidazolium salts.

Examples of the fluorinated surfactant include compounds that are derived from intermediates having at least one perfluoroalkyl group through any one of electrolytic fluorination, teromerization and origomerization methods. Examples of the fluorinated surfactant include perfluoroalkylsulfonic acid salts, perfluoroalkylcarboxylic acid salts, perfluoroalkyl ethylene oxide adducts, perfluoroalkyl trialkyl ammonium salts, perfluoroalkyl group-containing oligomers, and perfluoroalkyl phosphoric acid esters.

The silicon-containing surfactant is preferably silicone oil modified with at least one organic group, which may have a structure including at least one side chain of a siloxane structure which at least one side chain is modified with at least one organic group, a structure having modified terminals, or a structure having a single modified terminal. Examples of modification with at least one organic group include amino modification, polyether modification, epoxy modification, carboxyl modification, carbinol modification, alkyl modification, aralkyl modification, phenol modification and fluorine modification.

The content of the surfactant(s) in the coating liquid for an ink receiving layer is preferably 0.001 to 2.0% by mass, and more preferably 0.01 to 1.0% by mass. When two or more coating liquids are used to form an ink receiving layer, the surfactant(s) is preferably contained in each of the coating liquids.

In the invention, the ink receiving layer preferably contains at least one high boiling point organic solvent in order to prevent curling of the recording medium. The high boiling point organic solvent is an organic compound that has a boiling point of 150° C. or more at normal pressure and is water-soluble or hydrophobic. The compound may be liquid or solid at room temperature, and may be a low molecular weight compound or a high molecular weight compound.

Specific examples thereof include aromatic carboxylates (for example, dibutyl phthalate, diphenyl phthalate, and phenyl benzoate), aliphatic carboxylates (for example, dioctyl adipate, dibutyl sebacate, methyl stearate, dibutyl maleate, dibutyl fumalate, and triethyl acetylcitrate), phosphates (for example, trioctyl phosphate, and tricresyl phosphate), epoxy compounds (for example, epoxidized soybean oil, and epoxidized fatty acid methyl ester), alcohols (for example, stearyl alcohol, ethylene glycol, propylene glycol, diethylene glycol, triethylene glycol, glycerin, diethylene glycol monobutyl ether (DEGMBE), triethylene glycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine, and polyethylene glycol), vegetable oils (for example, soybean oil, and sunflower oil), and higher aliphatic carboxylic acids (for example, linoleic acid, and oleic acid).

Substrate

The substrate in the invention may be a transparent substrate made of at least one transparent material such as plastics, or an opaque substrate made of at least one opaque material such as paper. The substrate is preferably a transparent substrate or a highly glossy opaque substrate in order to take an advantage of transparency of the ink receiving layer.

Alternatively, the substrate may be a read-only optical disc such as CD-ROM or DVD-ROM, a write-once optical disc such as CD-R or DVD-R, or a rewritable optical disc. An ink receiving layer can be formed on the label side of the disc.

The material of the transparent substrate is preferably transparent and resistant to radiant heat generated when used in an OHP or back-light display. Typical examples thereof include polyesters such as polyethylene terephthalate (PET); polysulfone, polyphenylene oxide, polyimide, polycarbonate and polyamide. The material is preferably polyester, and more preferably polyethylene terephthalate.

There is no particular limit to the thickness of the substrate, but the thickness is preferably 50 to 200 μm from the viewpoint of easy handling.

The surface of the highly glossy opaque substrate on which surface the ink receiving layer is formed preferably has a glossiness of 40% or more. The glossiness is measured according to JIS P-8142 (75 degree specular gloss test method for paper sheets and paper board).

Specific examples of such a substrate include highly glossy paper substrates such as art paper, coated paper, cast-coated paper, and barite paper used as silver salt photographic substrates; highly glossy opaque films each of which is obtained by adding, for example, a white pigment to a film made of a plastic such as polyester, including polyethylene terephthalate (PET), cellulose ester such as nitrocellulose, cellulose acetate or cellulose acetate butylate, polysulfone, polyphenylene oxide, polyimide, polycarbonate or polyamide and which may be subjected to surface calendar treatment; and substrates having, on the surface of a paper support, a transparent support, or a highly glossy film containing at least one white pigment, coated layers made of polyolefin and containing or not containing at least one white pigment.

The substrate may also be a foamed polyester film containing at least one white pigment (for example, foamed PET that contains polyolefin fine particles, and in which voids are formed by drawing). Also, the substrate can be paper coated with at least one resin and used as silver salt photographic printing paper.

There is no particular limit to the thickness of the opaque substrate. However, the thickness is preferably 50 to 300 μm, considering easy handling.

The surface of the substrate may be subjected to corona discharge treatment, glow discharge treatment, flame treatment and/or UV irradiation treatment to improve the wetting and adhesive properties of the substrate.

A base paper sheet used in the paper substrate such as paper coated with at least one resin will be described in detail below.

The raw materials of the base paper sheet mainly contain wood pulp, and optionally synthetic pulp(s) such as polypropylene pulp, and/or synthetic fibers such as nylon or polyester fibers. Any of LBKP, LBSP, NBKP, NBSP, LDP, NDP, LUKP and NUKP may be used as the wood pulp. The content of at least one of LBKP, NBSP, LBSP, NDP and LDP pulps, which are abundant in short fibers, in the raw materials is preferably high. However, the content of LBSP and/or LDP is preferably 10% to 70% by mass.

The pulp is preferably chemical pulp (e.g., sulfate pulp or sulfite pulp) containing few impurities, and pulp that has been bleached to improve brightness is also useful.

The base paper sheet may appropriately contain at least one sizing agent such as higher fatty acid or alkylketene dimer, at least one white pigment such as calcium carbonate, talc or titanium oxide, at least one paper strength enhancing agent such as starch, polyacrylamide or polyvinyl alcohol, at least one fluorescent brightener, at least one moisture retention agent such as polyethylene glycol, at least one dispersant, and/or at least one softening agent such as quaternary ammonium.

The freeness, determined according to CSF, of the pulp used in paper making is preferably 200 to 500 ml. As for the length of fiber after beating, the sum of the rate of a 24 mesh filtration residue and that of a 42 mesh filtration residue, which are stipulated in JIS P-8207, is preferably 30 to 70% by mass. The rate of a 4 mesh filtration residue is preferably 20% by mass or less.

The basis weight of the base paper sheet is preferably 30 to 250 g/m$^2$, and more preferably 50 to 200 g/m$^2$. The thickness of the base paper sheet is preferably 40 to 250 μm. The base paper sheet may be subjected to calendar treatment during or after a paper making process so as to have highly smoothness. The density of the base paper sheet is generally 0.7 to 1.2 g/m$^2$ (JIS P-8118). The rigidity of the base paper sheet, measured under conditions stipulated in JIS P-8143, is preferably 20 to 200 g.

At least one surface sizing agent may be applied onto the surface of the base paper sheet, and each of the at least one surface sizing agent may be the same as the aforementioned sizing agent contained in the base paper sheet.

The pH of the base paper sheet, measured by a hot water extraction method stipulated in JIS P-8113, is preferably 5 to 9.

Polyethylene used to coat the front and back surfaces of the base paper sheet is mainly low density polyethylene (LDPE) and/or high density polyethylene (HDPE), but the coating material may further contain LLDPE, and/or polypropylene as well as polyethylene.

In particular, a polyethylene layer on which an ink receiving layer is formed preferably includes titanium oxide of rutile or anatase type, at least one fluorescent whitener and/or ultramarine blue to improve the opaqueness, whiteness, and hue of the substrate, as widely adopted in photographic printing paper. The amount of titanium oxide is preferably 3 to 20 parts by mass, and more preferably 4 to 13 parts by mass relative to 100 parts by mass of the polyethylene layer. There is no particular limit to the thickness of the polyethylene layer, but the thickness of the polyethylene layer on each of the front and back surfaces of the base paper sheet is preferably 10 to 50 μm. An undercoat layer may be provided on the polyethylene layer to improve the adhesion of the polyethylene layer to the ink receiving layer. The undercoat layer is preferably made of aqueous polyester, gelatin and/or PVA. The thickness of the undercoat layer is preferably 0.01 to 5 μm.

The paper coated with polyethylene may be used as glossy paper. Alternatively, the paper coated with polyethylene may have a matted surface or a silky surface, which ordinary photographic printing paper has. Such paper can be produced by melt-extruding polyethylene on the surfaces of a base paper sheet and subjecting the polyethylene to embossing treatment.

The substrate may have a back coat layer, and the back coat layer may include at least one white pigment, and at least one aqueous binder and, if necessary, any other component(s).

Examples of the white pigment contained in the back coat layer include inorganic white pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydrated halloysite, magnesium carbonate and magnesium hydroxide; and organic pigments such as styrene plastic pigments, acrylic plastic pigments, polyethylene, microcapsules, urea resin and melamine resin.

Examples of the aqueous binder used in the back coat layer include water-soluble polymers such as styrene/maleate copolymer, styrene/acrylate copolymer, polyvinyl alcohol, silanol-modified polyvinyl alcohol, starch, cationic starch, casein, gelatin, carboxymethyl cellulose, hydroxyethyl cellulose and polyvinyl pyrrolidone; and water-dispersible polymers such as styrene-butadiene latex and acrylic emulsion.

Examples of other components contained in the back coat layer include at least one defoaming agent, at least one foaming suppressing agent, at least one dye, at least one fluorescent brightener, at least one preservative and at least one waterproofing agent.

Method of Manufacturing Ink Jet Recording Medium

There is no particular limit to a method for forming the ink receiving layer of the ink jet recording medium of the invention, and the ink receiving layer can be produced by any of known application methods. Examples of an apparatus that can be used in known application methods include an extrusion die coater, an air doctor coater, a blade coater, a rod coater, a knife coater, a squeeze coater, a reverse roll coater, and a bar coater. The ink jet recording medium may have only one ink receiving layer or plural ink receiving layers on the substrate, and may further have at least one ink solvent-absorbing layer, at least one intermediate layer, and/or at least one protective layer. In the invention, the aforementioned inorganic mordant(s) may be uniformly contained in the ink receiving layer or may be localized in the vicinity of the surface of the ink receiving layer.

Preferably, the ink receiving layer is produced by a Wet-on-Wet method. In the Wet-on-Wet method, a first coating liquid containing fine particles and at least one water-soluble binder (hereinafter, may be called "coating liquid A") is applied to the surface of a substrate, and a second coating liquid containing at least one basic compound and having a pH of 7.1 or more (hereinafter, may be called "coating liquid B") is applied to the resultant first coating. Here, the application of the first coating liquid and the application of the second coating liquid are simultaneously conducted (1). Alternatively, the application of the second coating liquid is conducted when the first coating is drying and before the first coating exhibits a falling-rate drying speed (2). The coated layer obtained by applying the second coating liquid to the first coating is then cross-linked and hardened.

Here, the aforementioned compound having in the molecule thereof at least two kinds of polyvalent metal ions is preferably contained in at least one of coating liquids A and B, and more preferably contained in coating liquid A. Alternatively, one of raw materials each having one kind of polyvalent metal ion that can form the compound having in the molecule thereof at least two kinds of polyvalent metal ions may be contained in the first coating liquid (coating liquid A) and the remaining may be contained in the second coating liquid (coating liquid B), and the compound having in the molecule thereof at least two kinds of polyvalent metal ions may be formed by reacting these raw materials at the time of application of the first and second coating liquids. At least one cross-linking agent that can cross-link the water-soluble binder is preferably contained in at least one of coating liquids A and B. Preparing such a cross-linked and hardened ink receiving layer in the above manner is preferred from the viewpoints of a good ink-absorbing property and prevention of cracks in the ink receiving layer.

In the invention, a coating liquid for an ink receiving layer (coating liquid (A)) containing fine particles (for example, vapor-phase process silica) and at least one water-soluble binder (for example, polyvinyl alcohol) can be prepared, for example, as follows. The vapor-phase process silica fine particles and at least one dispersant are added to water. The amount of the silica fine particles is, for example, 10 to 20 parts by mass relative to 100 parts by mass of a dispersion liquid including water, the silica fine particles and the at least one dispersant. The silica fine particles are then dispersed in water with a wet-type high-speed rotary colloid mill (for example, CREAMIX manufactured by M Technique Co., Ltd.) under a high-speed rotation condition of, for example, 10,000 rpm (preferably 5,000 to 20,000 rpm) for, for example, 20 minutes (preferably 10 to 30 minutes) to form an aqueous dispersion. Thereafter, at least one cross-linking agent (e.g., a boron compound), and a polyvinyl alcohol (PVA) aqueous solution are added to the aqueous dispersion. Here, the amount of PVA may be, for example, about ⅓ by mass of the vapor-phase process silica. When a compound having in the molecule thereof at least two kinds of polyvalent metal ions is to be contained in the coating liquid for the ink receiving layer, the compound is also added to the aqueous dispersion at this time. The resultant mixture is stirred under rotation conditions the same as the above to prepare the coating liquid. The coating liquid is a uniform sol, and may be applied to a substrate according to the following application method and the resultant coating is dried to form a porous ink receiving layer having a three-dimensional network structure.

The aqueous dispersion including vapor-phase process silica and at least one dispersant may also be prepared by preparing a dispersion in which the vapor-phase process silica is dispersed in water, and adding the dispersion to a dispersant aqueous solution, or adding a dispersant aqueous solution to the dispersion, or mixing the dispersion and a dispersant aqueous solution. Alternatively, powder of the vapor-phase process silica rather than the dispersion in which the vapor-phase process silica is dispersed in water may be added to the dispersant aqueous solution.

After the vapor-phase process silica and the at least one dispersant are mixed, the resultant mixture may be stirred with a dispersing apparatus to fine the particles contained therein. Thus, an aqueous dispersion with particles having an average diameter of 50 to 300 nm can be obtained. The dispersing apparatus used to obtain the aqueous dispersion may be any of various known dispersing apparatuses such as a high-speed rotary dispersing apparatus, a dispersing apparatus that conducts stirring with a medium (e.g., a ball mill, and a sand mill), an ultrasonic dispersing apparatus, a colloid mill dispersing apparatus, and a high-pressure dispersing apparatus, and, to effectively fine agglomerates, is preferably a dispersing apparatus that conducts stirring with a medium, a colloid mill dispersing apparatus or a high-pressure dispersing apparatus.

At least one solvent can be used in each of the steps of the coating liquid production method. The at least one solvent may be water, an organic solvent or a mixture thereof. Examples of at least one organic solvent that can be used in the coating include alcohols such as methanol, ethanol, n-propanol, isopropanol and methoxypropanol; ketones such as acetone and methyl ethyl ketone; and tetrahydrofuran, acetonitrile, ethyl acetate and toluene.

The dispersant may be a cationic polymer. The cationic polymer may be one of the aforementioned organic mordants. The dispersant may also be a silane coupling agent.

The amount of the dispersant(s) is preferably 0.1 to 30 parts by mass, and more preferably 1 to 10 parts by mass relative to 100 parts by mass of the fine particles.

The ink receiving layer formed on the substrate may be subjected to calendar treatment so as to improve the surface smoothness, glossiness, transparency and strength of the ink receiving layer. The calendar treatment may be conducted with a super calendar or gloss calendar machine and conducted by making the substrate with the ink receiving layer to pass through the nip portion between rolls that are being heated and press against each other. However, the calendar treatment may decrease the percentage of void of the ink receiving layer, which results in a decrease in the ink-absorbing property of the ink receiving layer. Therefore, it is necessary that the calendar treatment be conducted under conditions that hardly decrease the percentage of void.

The temperature of the rolls in the calendar treatment is preferably 30 to 150° C., and more preferably 40 to 100° C.

The linear pressure between the rolls in the calendar treatment is preferably 50 to 400 kg/cm, and more preferably 100 to 200 kg/cm.

When the recording medium of the invention is used in ink jet recording, the recording medium should include an ink receiving layer having an ink absorption capacity that allows the ink receiving layer to absorb all ink droplets deposited thereon. Therefore, the thickness of the ink receiving layer should be determined in consideration of the percentage of void of the ink receiving layer. For example, the thickness should be about 15 μm or more when the amount of the ink is 8 nl/mm$^2$ and the percentage of void is 60%.

The thickness of the ink receiving layer of the ink jet recording medium is preferably 10 to 50 μm, considering the above point.

When the ink receiving layer is porous, the median pore diameter of the ink receiving layer is preferably 0.005 to 0.030 μm, and more preferably 0.01 to 0.25 μm.

The percentage of void and the median pore diameter can be measured with a mercury porosimeter (e.g., PORESIZER-9320-PC2 manufactured by Shimadzu Corporation).

The ink receiving layer preferably has excellent transparency, and the criterion of transparency may be a haze value. When formed on a transparent film substrate, the haze value of the ink receiving layer is preferably 30% or less, and more preferably 20% or less.

The haze value is measured with a haze meter (e.g., HGM-2DP manufactured by Suga Test Instrument Co., Ltd.).

Polymer fine particles may be dispersed in at least one of the constituent layers of the ink jet recording medium of the invention (for example, the ink receiving layer or back layer). The polymer fine particles are used to improve film properties such as dimensional stability, curling prevention, adhesion prevention and crack prevention. The polymer fine particles are added to the other components of a coating liquid for an ink receiving layer in the form of, for example, a dispersion. The dispersion is described in JP-A Nos. S62-245258 and H10-228076. When a layer of a recording medium which layer contains at last one mordant includes polymer fine particles dispersed therein and having a low glass transition temperature (e.g., 40° C. or less), cracking of the layer and curling of the recording medium can be prevented. The curling of the recording medium may also be prevented, when the back layer contains polymer fine particles having a high glass transition temperature.

The ink jet recording medium of the invention can also be manufactured by any of methods described in JP-A Nos. H10-81064, H10-119423, H10-157277, H10-217601, H11-348409, 2001-138621, 2000-43401, 2000-211235, 2000-309157, 2001-96897, 2001-138627, H11-91242, H08-2087, H08-2090, H08-2091, and H08-2093.

As aforementioned, an undercoat layer may be provided on the substrate to improve the adhesion between the ink receiving layer and the substrate and to properly adjust the electric resistance value of the recording medium.

The recording medium of the invention may have an ink receiving layer on only one side of a substrate. Alternatively, the recording medium of the invention may have an ink receiving layer on each side of a substrate to prevent deformation of the recording medium such as curling. When the recording medium has an ink receiving layer on only one side of a substrate and is used in an OHP, the recording medium may have a reflection preventing film on the other side or each side of the substrate for the purpose of improving light transmittance.

In addition, a surface of the substrate may be coated with boric acid or a boron compound and an ink receiving layer may be formed on the coated surface to ensure the glossiness and the surface smoothness of the ink receiving layer and to suppress bleeding of a printed image over time under an environment of high temperature and high humidity.

Ink Jet Recording Method

In the ink jet recording method of the invention, there is no limit to a process of ejecting an ink. An ink may be ejected by any of known processes such as a charge control process in which an ink is ejected using electrostatic attractive force, a drop-on-demand process (pressure pulse process) utilizing the vibration pressure of piezo elements, a sound ink jet recording process in which an electric signal is converted into sound beams, the sound beams are irradiated on an ink, and the resultant radiation pressure is used to eject the ink, and a thermal ink jet recording process in which an ink is heated to form air bubbles and the pressure resulted therefrom is used to eject the ink. In these ink jet recording processes, an ink with a low concentration, called a photoink, may be ejected in the form of many droplets having a small volume, or plural kinds of inks having substantially the same hue and different concentrations may be used to form an image with improved image quality, or colorless and transparent ink may be used.

<Digital Electrophotographic Recording Medium>

The recording medium of the invention can be used as a digital electrophotographic recording medium.

The digital electrophotographic recording medium has at least one toner receiving layer and, if necessary, further has any other layer selected from at least one surface protective layer, at least one intermediate layer, at least one undercoat layer, at least one cushion layer, at least one charge control (antistatic) layer, at least one reflecting layer, at least one color adjusting layer, at least one storability improving layer, at least one adhesion preventing layer, at least one anti-curl layer, and at least one smoothing layer. The compound represented by Formula (1) is preferably contained in any of these layers, and more preferably contained in the toner receiving layer.

Toner Receiving Layer

The toner receiving layer receives at least one of color and black toners to form an image thereon. The toner receiving layer has functions of receiving at least one toner for forming an image from a developing drum or an intermediate transfer medium due to, for example, (static) electricity and/or pressure in a transfer step, and allowing the at least one toner to be fixed thereon in a fixing step due to, for example, heat and/or pressure. The toner receiving layer preferably contains at least one thermoplastic resin, and, if necessary, further contains other component(s).

Thermoplastic Resin

The thermoplastic resin is a material that can deform at a certain temperature such as a fixing temperature and that can receive at least one toner, and otherwise there is no particular limit thereto. The thermoplastic resin may be appropriately selected from known thermoplastic resins. The thermoplastic resin is preferably such that a toner receiving layer made with the thermoplastic resin satisfies desired physical properties.

The toner receiving layer can contain at least one coloring agent such as at least one pigment or at least one dye, at least one plasticizer, at least one releasing agent, at least one lubricant, at least one matting agent, at least one filler, at least one cross-linking agent, at least one charge control agent, at least one emulsion, or at least one dispersion in addition to the thermoplastic resin.

The content of the thermoplastic resin(s) in the toner receiving layer is preferably 50% by mass or more, and more preferably 50 to 90% by mass.

<Heat-Sensitive Recording Medium>

The recording medium of the invention can also be used as a heat-sensitive recording medium.

The heat-sensitive recording medium is used in, for example, a thermo auto-chrome method (TA method) in which an image is formed by repeating heating with a heat-sensitive head and fixing due to irradiation of ultraviolet light. The heat-sensitive recording medium has at least one heat-sensitive color-forming layer as at least one recording layer on a substrate.

<Sublimation Transfer Recording Medium>

The recording medium of the invention can also be used as a sublimation transfer recording medium.

The sublimation transfer recording medium has at least one receiving layer for receiving at least one thermal diffusion coloring agent (sublimation coloring agent) as at least one recording layer. The recording medium for sublimation transfer is used in, for example, a sublimation transfer method in which at least one transfer material with at least one ink layer including at least one thermal coloring agent is heated with a heat-sensitive head so as to transfer the thermal diffusion coloring agent(s) to a recording medium.

<Thermal Transfer Rerecording Medium>

The recording medium of the invention can also be used as a thermal transfer rerecording medium.

The thermal transfer rerecording medium has at least one thermal transfer image receiving layer, which receives an ink, as at least one recording layer. Such a recording medium is used in, for example, a method in which at least one thermal transfer material having at least one thermally melting ink layer is heated with a heat-sensitive head and the ink contained in the ink layer is melted and transferred to a recording medium serving as a thermal transfer image receiving material.

The digital electrophotographic recording medium, the sublimation transfer recording medium, the heat-sensitive recording medium, and the thermal transfer recording medium can be manufactured in the same manner as the ink jet recording medium, except that the ink jet recording layer is replaced with the corresponding recording layer (i.e., a toner receiving layer, a sublimation transfer image receiving layer, a heat-sensitive coloring layer, or a thermal transfer image receiving layer). Here, these recording media are so manufactured that at least one of the constituent layers thereof includes the compound represented by Formula (1). The digital electrophotographic recording medium is preferably any of those described in JP-A Nos. 2000-275891, 2000-292963, 2000-352834, and 2000-13710, and the sublimation transfer recording medium is preferably that described in JP-A No. H03-275387, and the heat-sensitive recording medium is preferably that described in JP-A No. H05-169802, and the thermal transfer recording medium is preferably any of those described in JP-A Nos. H02-106392 and H02-167794.

EXAMPLES

Hereinafter, the invention will be described in more detail, while referring to the following examples. However, the invention is not limited to these examples. The terms "part" and "%" in the examples are "part by mass" and "% by mass", unless otherwise specified.

Example 1

Manufacture of Substrate

Each of fifty parts of LBKP made from acacias and 50 parts of LBKP made from aspens was so beaten with a disk refiner that the Canadian freeness of the beaten pulp was 300 ml. Thus, pulp slurries were prepared, and mixed.

1.3 parts of cationic starch (CATO 304L manufactured by Nippon NSC), 0.15 parts of anionic polyacrylamide (POLYACRONE ST-13 manufactured by Seiko Chemical), 0.29 parts of alkylketene dimmer (SIZE PINE K manufactured by Arakawa Chemical Industries, Ltd.), 0.29 parts of epoxidized behenic acid amide, and 0.32 parts of polyamide polyamine epichlorohydrin (ARAFIX 100 manufactured by Arakawa Chemical Industries, Ltd.) were added to 100 parts of the mixed pulp slurry. Thereafter, 0.12 parts of an anti-foaming agent was added to the resultant mixture.

A paper web having a felt side and a wire side was made from the resulting blend with a Fourdrinier machine, and the felt side of the web was pressed against a cylindrical drum dryer with a dryer canvas to dry the paper web. At this time, the tensile force of the dryer canvas was set to be 1.6 kg/cm. Thereafter, polyvinyl alcohol (KL-118 manufactured by Kuraray Co., Ltd.) was applied to each side of the web in an amount of 1 g/m$^2$ with a size press, and dried, and the coated web was subjected to calendar treatment. Thus, a base paper sheet having a basic weight of 166 g/m$^2$ and a thickness of 160 μm was obtained.

After the wire side of the base paper sheet was subjected to corona discharge treatment, high-density polyethylene was coated on one surface of the base paper sheet with a melt extruder so as to form a thermoplastic resin layer having a thickness of 25 μm and a matted surface. Hereinafter, the surface of the thermoplastic resin layer is called a "back surface". The back surface of the thermoplastic resin layer was subjected to corona discharge treatment. Thereafter, a dispersion liquid in which aluminum oxide (ALUMINA SOL 100 manufactured by Nissan Chemical Industries, Ltd.) and silicon dioxide (SNOWTEX O manufactured by Nissan Chemical Industries, Ltd.) were dispersed in water at a mass ratio of 1:2 was applied to the thermoplastic layer so as to form a layer having a dry coating amount of 0.2 g/m$^2$. Thus, a substrate was obtained.

-Preparation of Coating Liquid A for Ink Receiving Layer (First Liquid)-

(1) Vapor-phase process silica fine particles, (2) deionized water, (3) "SHAROL DC-902P", and (4) "ZA-30" in the following composition were mixed and stirred with a bead mill (KD-P manufactured by Shinmaru Enterprises Corporation) containing zirconia beads. The resultant dispersion liquid was heated to 45° C. and kept at the temperature for 20 hours. Thereafter, (5) boric acid, (6) a polyvinyl alcohol solution, (7) "SUPER FLEX 600", (8) polyoxyethylene lauryl ether, and (9) ethanol were added to the dispersion liquid at 30° C. to prepare coating liquid A for an ink receiving layer (first liquid).

| Composition of coating liquid A for ink receiving layer | |
|---|---|
| (1) Vapor-phase process silica fine particles (inorganic fine particles)(AEROSIL 300SF75 manufactured by Nippon Aerosil Co., Ltd.) | 10.0 parts |
| (2) Deionized water | 64.8 parts |
| (3) "SHAROL DC-902P" (51.5% aqueous solution) (dispersant manufactured by Dai-ichi Kogyo Seiyaku Co., Ltd.) | 0.87 parts |
| (4) "ZA-30" (zirconium acetate) | 0.54 parts |
| (5) Boric acid (cross-linking agent) | 0.37 parts |
| (6) Polyvinyl alcohol (water-soluble resin) solution | 29.4 parts |
| Composition of polyvinyl alcohol solution | 2.03 parts |
| "PVA235" having a degree of saponification of 88%, and a degree of polymerization of 3500, and manufactured by Kuraray Co., Ltd. | |
| Polyoxyethylene lauryl ether (surfactant) | 0.03 parts |
| The following compound 1 | 0.06 parts |
| Diethylene glycol monobutyl ether (BUTYCENOL 20P manufactured by Kyowa Hakko Kogyo Co., Ltd.) | 0.68 parts |
| Deionized water | 26.6 parts |
| (7) "SUPER FLEX 600" (manufactured by Dai-ichi Kogyo Seiyaku Co., Ltd.) | 1.24 parts |
| (8) Polyoxyethylene lauryl ether (surfactant) ("EMULGEN 109P" (10% aqueous solution) having an HLB value of 13.6, and manufactured by Kao Corporation) | 0.49 parts |
| (9) Ethanol | 2.49 parts |

Compound 1

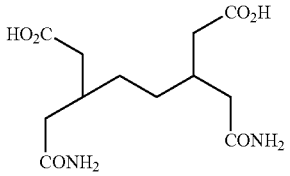

-Preparation of Coating Liquid B for Ink Receiving Layer (Second Liquid)-

The compound 2 (2) in the following composition was dissolved in (5) deionized water, and ammonia water was added to the resultant solution so as to adjust the pH of the solution at 7.5. Thereafter, (1) boric acid, (3) zirconyl ammonium carbonate, (4) ammonium carbonate, and (6) polyoxyethylene lauryl ether (surfactant) were added to the solution. Ammonia water was added to the resultant mixture so as to adjust the pH of the mixture within the range of 8.5 to 9.0 to prepare coating liquid B (second liquid).

| Composition of coating liquid B for ink receiving layer | |
|---|---|
| (1) Boric acid | 0.65 parts |
| (2) Compound 2 shown below | 2.7 parts |
| (3) Zirconyl ammonium carbonate (ZIRCOSOL AC-7 [28% aqueous solution] manufactured by Daiichi Kigenso Kagaku Kogyo Co., Ltd.) | 2.5 parts |
| (4) Ammonium carbonate (first grade product manufactured by Kanto Chemical Co., Inc.) | 5.0 parts |
| (5) Deionized water | 60.0 parts |

-continued

| Composition of coating liquid B for ink receiving layer | |
|---|---|
| (6) Polyoxyethylene lauryl ether (surfactant) (EMULGEN 109P (2% aqueous solution) having an HLB value of 13.6, and manufactured by Kao Corporation) | 30.0 parts |

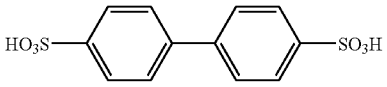

Compound 2

Manufacture of Recording Medium

After the front surface of the substrate was subjected to corona discharge treatment, the coating liquid A for an ink receiving layer (first liquid) and an aqueous solution obtained by diluting poly aluminum chloride (ALFINE 83 manufactured by Taimei Chemicals Co., Ltd) with water five times were applied to the front surface with in-line coating apparatuses in respective application amounts of 173 ml/m$^2$ and 10.8 ml/m$^2$. Then, the applied layer was dried at 80° C. with a hot air dryer at a wind speed of 3 to 8 m/sec, until the concentration of the solid matter in the layer became 20%. The layer exhibited a constant-rate speed of drying during the drying. Before the layer exhibited a falling-rate speed of drying, the substrate was immersed in the coating liquid B (second liquid) of the aforementioned composition for three seconds to adhere the coating liquid B to the applied layer in an amount of 13 g/m$^2$, and the layer was further dried at 80° C. for 10 minutes (hardening process). As a result, a recording medium of Example 1 with an ink receiving layer having a dry thickness of 32 μm was manufactured.

Example 2

A recording medium of Example 2 was manufactured in the same manner as in Example 1, except that the compound 2 was replaced with the following compound 3.

Compound 3

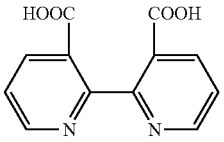

Comparative Example 1

A recording medium of Comparative Example 1 was manufactured in the same manner as in Example 1, except that the compound 2 was replaced with the following compound 4.

Compound 4

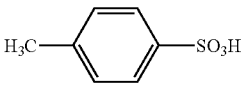

Comparative Example 2

A recording medium of Comparative Example 2 was manufactured in the same manner as in Example 1, except that the compound 2 was replaced with the following compound 5.

Compound 5

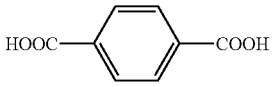

Comparative Example 3

A recording medium of Comparative Example 3 was manufactured in the same manner as in Example 1, except that the compound 2 was replaced with the following compound 6.

Compound 6

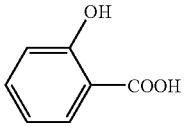

Comparative Example 4

A recording medium of Comparative Example 3 was manufactured in the same manner as in Example 1, except that the compound 2 was not contained in the coating liquid B.

Evaluation (1) Yellowing in White Background Portion

The recording media were put in a clear file (manufactured by Kokuyo Co., Ltd.) and stored in an environment of 45° C. and 50% for three days. Thereafter, a part of the file was cut off. The recording media were further stored in an environment of 23° C. and 65% for three days. A visual check was made to determine whether the color of the white background portion of a part of each of the recording media which part had been kept in contact with the file changed.

A: The color did not change.

B: The color slightly changed.

C: The color remarkably changed.

(2) Ozone Resistance

Magenta and cyan solid images were respectively printed on each of the recording media with an ink jet printer (PM-G800 manufactured by Seiko Epson Corporation). The density of each of the magenta and cyan solid images was measured with a reflection densitometer (XRITE 938 manufactured by Xrite Corp.). Thereafter, the recorded media were stored in an environment containing ozone at a concentration of 10 ppm for 48 hours. The density of each of the magenta and cyan solid images was measured again with the reflection densitometer. The remaining rates of magenta and cyan concentrations were calculated from the measured values.

When the remaining rate was 80% or more, the ozone resistance of the recording medium was ranked as grade A. When the remaining rate was not less than 70% and less than 80%, the ozone resistance of the recording medium was ranked as grade B. When the remaining rate was not less than 60% and less than 70%, the ozone resistance of the recording medium was ranked as grade C. When the remaining rate was less than 60%, the ozone resistance of the recording medium was ranked as grade D.

The same procedures except that the PM-G800 ink jet printer was replaced with another ink jet printer, PIXUS 8600 manufactured by Canon Corp, were repeated.

(3) Evaluation of Bleeding

A stripe pattern that had a line width of 0.28 mm and in which magenta lines and black lines were alternately arranged was printed on each of the recording media with an ink jet printer (PM-970C manufactured by Seiko Epson Corporation). Just after the printing, the printed recording media were put in a file made of transparent polypropylene and stored in an environment of 35° C. and 80% RH for three days. Thereafter, a visual check was made to determine whether bleeding of the black lines occurred.

A: No bleeding was found.

B: Bleeding was somewhat found, but was practically acceptable.

C: Bleeding was found, and was not practically acceptable.

(4) Evaluation of Bronzing

A deep blue solid image was printed on each of the recording media with the ink jet printer (PM-G800 manufactured by Seiko Epson Corporation), and the recording media were left for one day. Thereafter, a visual check was made to determine whether bronzing of the image occurred. Recording media without bronzing were ranked as A and those with bronzing were ranked as B.

(5) Print Density

A deep black solid image was printed on each of the recording media with the ink jet printer (PM-G800 manufactured by Seiko Epson Corporation), and dried in an environment of 25° C. and 60% RH for one day. Thereafter, the density of the image was measured with the reflection densitometer (XRITE 938 manufactured by Xrite Corp.).

The test results are shown in Table 1.

TABLE 1

| | | Ozone resistance | | | | | | |
|---|---|---|---|---|---|---|---|---|
| | | PM-G 800 | | PIXUS 8600i | | | | Print |
| | Yellowing | Magenta | Cyan | Magenta | Cyan | Bleeding | Bronzing | density |
| Ex. 1 | A | A | A | B | A | A | A | 2.11 |
| Ex. 2 | A | A | A | B | A | A | A | 2.10 |
| Comp. Ex. 1 | A | B | A | C | B | A | A | 1.90 |
| Comp. Ex. 2 | A | B | A | C | B | A | A | 1.99 |
| Comp. Ex. 3 | A | B | A | C | B | A | A | 2.01 |
| Comp. Ex. 4 | A | B | B | C | B | A | A | 2.11 |

Table 1 clearly shows that the recording media of Examples 1 and 2 have superior ozone resistance and higher print density without deteriorating yellowing in the white background portion, bronzing, and bleeding to the recording media of Comparative Examples 1-4.

What is claimed is:

1. A recording medium comprising a substrate and a recording layer on the substrate, wherein the recording layer contains a water-soluble binder, a cross-linking agent that can cross-link the water-soluble binder, fine particles and a compound shown by the following Formula (I):

$$(Y^1)_n—Z^1—(X)_l—Z^2—(Y^2)_m \qquad \text{Formula (I)}$$

wherein, in Formula (I): each of $Z^1$ and $Z^2$ indicates a substituted or unsubstituted aromatic ring which may have a hetero atom; X indicates —O—, —S—, —S—S—, or —$C(R)_2$—; R indicates an alkyl group or a hydrogen atom; each of $Y^1$ and $Y^2$ indicates a sulfo group, a carboxyl group, a phosphono group, a carbonamide group, a sulfonamide group, or a quaternary ammonium salt; l indicates 0 or 1; and each of m and n indicates 0 or an integer of 1 or more, and at least one of m and n is an integer of 1 or more, and wherein the recording medium is for use in a recording medium for ink jet recording.

2. The recording medium according to claim 1, wherein each of the aromatic rings shown by $Z^1$ and $Z^2$ in Formula (I) is selected from a benzene ring, a pyridine ring, a pyrimidine ring, and a quinoline ring.

3. The recording medium according to claim 1, wherein each of $Y^1$ and $Y^2$ in Formula (I) is selected from substituted and unsubstituted sulfo groups and substituted and unsubstituted carboxyl groups.

4. The recording medium according to claim 1, wherein the water-soluble binder is at least one kind selected from polyvinyl alcohol resin, cellulose resin, resin having an ether bond, resin having a carbamoyl group, resin having a carboxyl group, and gelatin.

5. The recording medium according to claim 4, wherein the water-soluble binder is a polyvinyl alcohol resin.

6. The recording medium according to claim 1, wherein the fine particles are at least one kind selected from silica fine particles, colloidal silica, alumina fine particles, and pseudoboebmite.

7. The recording medium according to claim 1, wherein the recording layer further contains a mordant.

8. The recording medium according to claim 1, wherein the recording layer further contains a compound having at least two kinds of multivalent metallic atoms in a molecule.

9. The recording medium according to claim 8, wherein the compound having at least two kinds of multivalent metallic atoms in a molecule is a composite compound containing zirconium and aluminum.

10. A method for manufacturing the recording medium according to claim 1, comprising: applying a coating liquid containing fine particles and a water-soluble binder to form a coated layer, and applying a basic solution having pH of 7.1 or more to the coated layer to cross-link and harden the coated layer to form a recording layer, wherein at least one of the coating liquid and the basic solution contains a cross-linking agent, and the applying basic solution to the coated layer is conducted at the same time as the formation of the coated layer, or at a time when the coated layer is drying and before the coated layer exhibits falling-rate drying.

11. The recording medium according to claim 1, wherein the fine particle is Vapor phase process silica.

12. The recording medium according to claim 1, wherein the cross-linking agent is a boron compound.

13. The recording medium according to claim 1, wherein an ink receiving layer is produced by a wet-on-wet method when the recording layer is the ink receiving layer in ink jet recording.

* * * * *